US005853951A

United States Patent [19]

Yasuda et al.

[11] Patent Number: 5,853,951

[45] **Date of Patent: *Dec. 29, 1998**

[54] SILVER HALIDE PHOTOGRAPHIC MATERIAL

[75] Inventors: Shoji Yasuda; Tadashi Ito; Takahiro Goto; Hirotomo Sasaki; Seiichi Yamamoto, all of Minami-Ashigara, Japan

[73] Assignee: Fuji Photo Film Co., LTD., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 725,237

[22] Filed: Oct. 3, 1996

[30] Foreign Application Priority Data

| | | | |
|---|---|---|---|
| Oct. 5, 1995 | [JP] | Japan | 7-282418 |
| Oct. 6, 1995 | [JP] | Japan | 7-284338 |
| Oct. 11, 1995 | [JP] | Japan | 7-288104 |
| Nov. 27, 1995 | [JP] | Japan | 7-307186 |

[51] Int. Cl.[6] ..... G03C 1/09; G03C 1/34

[52] U.S. Cl. ..... 430/264; 430/600; 430/601; 430/603; 430/517; 430/606; 430/608

[58] Field of Search ..... 430/264, 601, 430/603, 606, 608, 600, 517

[56] References Cited

U.S. PATENT DOCUMENTS

| | | | |
|---|---|---|---|
| 4,835,093 | 5/1989 | Janusonis et al. | 430/606 |
| 4,933,272 | 6/1990 | McDugle et al. | 430/606 |
| 5,236,807 | 8/1993 | Ihoue et al. | 430/606 |
| 5,238,807 | 8/1993 | Sasaki et al. | 430/603 |
| 5,279,933 | 1/1994 | Gingello et al. | 430/606 |
| 5,281,513 | 1/1994 | Goto et al. | 430/606 |
| 5,283,169 | 2/1994 | Goto | 430/603 |
| 5,340,695 | 8/1994 | Yamaguchi | 430/603 |
| 5,348,850 | 9/1994 | Yoshida | 430/601 |
| 5,609,997 | 3/1997 | Okamoto et al. | 430/603 |
| 5,677,117 | 10/1997 | Yamamoto et al. | 430/603 |

FOREIGN PATENT DOCUMENTS

| | | |
|---|---|---|
| 7234472 | 5/1995 | Japan . |

*Primary Examiner*—Richard L. Schilling

*Attorney, Agent, or Firm*—Sughrue, Mion, Zinn, Macpeak & Seas, PLLC

[57] ABSTRACT

A silver halide photographic material comprising a support having thereon at least one silver halide emulsion layer, wherein: the silver halide emulsion layer comprises a silver halide comprising silver chloride or silver chlorobromide having a silver chloride content of not less than 95 mol %; the silver halide emulsion comprises at least one transition metal selected from the group consisting of elements belonging to the groups V to VIII of the periodic table, which has one nitrosyl, thionitrosyl or aquo ligand per molecule; and the silver halide is chemically sensitized with a selenium compound selected from compounds represented by one of formulae SE-1 to SE-8 disclosed in the specification.

10 Claims, No Drawings

SILVER HALIDE PHOTOGRAPHIC MATERIAL

FIELD OF THE INVENTION

The present invention relates to a silver halide black-and-white photographic material for forming a silver image as a final image. Particularly, the invention relates to a silver halide black-and-white photographic material for dot to dot work which can be handled in the environment which can be called substantially a daylight room; is capable of forming a high contrast negative silver image; and is suitable for the field of photomechanical process.

BACKGROUND OF THE INVENTION

Of the photomechanical steps of the print duplication field, improvement of the operating efficiency and the working environment has been contrived by conducting operations under brighter environment, particularly, in the page making-up step and the dot to dot work step, and silver halide photographic materials for photomechanical process which can be handled in the environment capable of being called substantially a daylight room have been offered.

A method of using a emulsion prepared by adding inorganic and organic desensitizers such as rhodium salt, iridium salt, Pinakryptol Yellow, phenosafranine and the like to a silver halide emulsion mainly comprising silver chloride is well known as a method of producing photographic materials which can be handled in a daylight room by lowering the sensitivity of the material to the visible light. In particular, a method of adding a rhodium salt and/or an organic desensitizer to finely grained silver chloride or a finely grained silver chlorobromide emulsion having a grain size of from 0.05 to 0.5 $\mu$m which are not chemically sensitized is preferably used. Moreover, a method of incorporating a yellow dye and an ultraviolet absorbing dye into a photographic material in combination with these emulsions is used for adjusting sensitivity and imparting the safety of safelight.

On the other hand, photographic materials used for page making-up and dot to dot work steps are required to have superhigh contrast photographic characteristics for excellently reproducing line works and halftone images, that is, required to have a high blacking density such that an image area and a non-image area are discriminated clearly. In particular, when exposing with overlapping a halftone image and a line original as a dot to dot work original (so-called formation of a letter image), a photographic material having good reproducibility of a line original (letter image quality) is required.

Further, in recent years, high precision printing in which a line number constituting a halftone image is increased is prevailing as a grade of printed matters becomes high. In high precision printing in which a dot area is apt to increase, there is a drawback of resulting in extremely reduced Dmax because the standard exposure (e.g., the exposure amount necessary to convert dot areas to negative/positive images) is less than that of 175 lines of general printed matters.

A method of incorporating a hydrazine based nucleating agent or a tetrazolium compound into a photographic material is known as a method of imparting superhigh contrast photographic characteristics to the photographic material, but when this method is combined with the above-described method of incorporating inorganic and organic desensitizers, a yellow dye and an ultraviolet absorbing dye into a photographic material, there occasionally arise problems such that a high contrast effect due to a hydrazine based compound or a tetrazolium compound is hindered, or good line work reproducibility is lost.

Image systems which provides superhigh photographic characteristics of a silver halide black-and-white photographic material for dot to dot work disclosed in JP-A-60-140338 (the term "JP-A" as used herein means an "unexamined published Japanese patent application"), JP-A-61-238049, JP-A-63-183438, JP-A-63-296034, JP-A-61-198147, JP-A-61-198148 and JP-A-61-240235. However, the pH of a developing solution used in these methods is 11 or more.

As a developing solution having a pH of not less than 11 is liable to be oxidized by air, unstable, and cannot be preserved for a long period of time, a system capable of providing a high contrast image by being developed with a low pH developing solution using a silver halide photographic material containing a hydrazine based nucleating agent has been desired.

However, if the pH of a developing solution is low, a high contrast effect due to a hydrazine based nucleating agent is deteriorated and a high contrast image cannot be obtained.

Development of a further highly active hydrazine nucleating agent and nucleation accelerator has been attempted, but such compounds occasionally deteriorate the storage stability for a long term of photographic materials.

SUMMARY OF THE INVENTION

An object of the present invention is to provide a silver halide photographic material for dot to dot work having superhigh contrast photographic characteristics which can be handled under a bright safelight (substantially a daylight room).

Another object of the present invention is to provide a silver halide photographic material which can be handled under a bright safelight (substantially a daylight room) and has good reproducibility of a line work (letter image quality).

A further object of the present invention is to provide a silver halide photographic material which can be handled under a bright safelight (substantially a daylight room), and has high Dmax in a high precision use.

A still further object of the present invention is to provide a silver halide photographic material which shows superhigh photographic characteristics even when developed with a low pH developing solution having a pH of not more than 11 and therefore being stable against air oxidation, and has excellent letter image quality.

A still yet further object of the present invention is to provide a silver halide photographic material which is stable when preserved for a long period of time.

These and other objects of the present invention have been achieved by a silver halide photographic material comprising a support having thereon at least one silver halide emulsion layer, wherein:

- the silver halide emulsion layer comprises a silver halide comprising silver chloride or silver chlorobromide having a silver chloride content of not less than 95 mol %;
- the silver halide emulsion comprises at least one transition metal selected from the group consisting of elements belonging to the groups V to VIII of the periodic table, the transition metal having one nitrosyl, thionitrosyl or aquo ligand per molecule; and
- the silver halide is chemically sensitized with a selenium compound selected from compounds represented by one of the following formulae SE-1 to SE-8:

SE-1

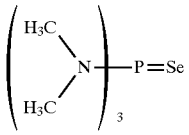

SE-2

$(C_2H_5O)_2P(=O)SeNa$

SE-3

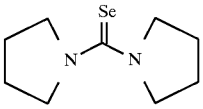

SE-4

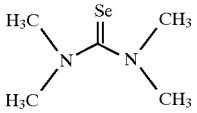

SE-5

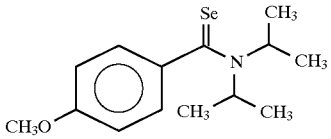

SE-6

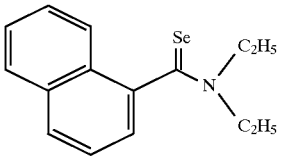

SE-7

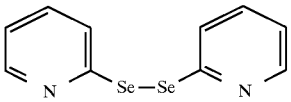

SE-8

$(^n\text{-}C_4H_9O)_3P{=}Se$

In general, a silver halide emulsion for use in a daylight room is not chemically sensitized because high sensitivity is not required. Further, a silver halide emulsion having a high silver chloride content is used for daylight room use in view of safety of safelight, but such an emulsion is liable to generate fog due to chemical sensitization and therefore has poor storage stability. In particular, when a highly active hydrazine derivative which provides high contrast even with a low pH developing solution is incorporated into a photographic material, fog markedly increases with the lapse of time.

The present inventors have found that excellent storage stability for a long period of time and superhigh contrast photographic characteristics can be obtained, even when a highly active hydrazine derivative is contained in a photographic material, by incorporating the above-described heavy metal into a high silver chloride content emulsion and by chemically sensitizing the emulsion using a specific selenium compound as used in the present invention.

DETAILED DESCRIPTION OF THE INVENTION

The present invention is described in detail below.

The silver halide for use in the silver halide emulsion of the silver halide photographic material according to the present invention is silver chloride or silver chlorobromide comprising 95 mol % or more, preferably 98 mol % or more, of silver chloride. When the silver bromide ratio increases, safety of safelight in a daylight room deteriorates or development progress lowers and γ decreases. Pure silver chloride is particularly preferred in view of the safety of safelight and the rapid processing capability.

The silver halide emulsion according to the present invention contains at least one transition metal selected from the elements belonging to one of the groups V to VIII of the periodic table, which has one ligand selected from nitrosyl, thionitrosyl or aquo per molecule.

The above described heavy metals are preferably coordinated metal complexes, in particular, coordinated metal complexes having six ligands represented by the following formula:

$$[M(Y)L_5]^n$$

wherein M represents a transition metal selected from the elements belonging to one of the groups V to VIII of the periodic table; Y represents NO, NS or $H_2O$; L represents a crosslinking ligand; and n represents −1 or −2.

Preferred examples of L include a halogen ligand (e.g., fluorine ligand, chlorine ligand, bromine ligand, iodine ligand), a cyanogen ligand, a cyanate ligand, a thiocyanate ligand, a selenocyanate ligand, a tellurocyanate ligand and an azido ligand.

Specific examples of the coordinated metal complexes are shown below, but the present invention is not limited thereto.

M-1 $[Rh(H_2O)Cl_5]^{-2}$
M-2 $[Ru(NO)Cl_5]^{-2}$
M-3 $[Ru(H_2O)Cl_5]^{-2}$
M-4 $[Ru(NS)Cl_5]^{-2}$
M-5 $[Fe(H_2O)CN_5]^{-2}$
M-6 $[Ir(NO)Cl_5]^{-2}$
M-7 $[Ir(NO)Cl_5]^{-1}$
M-8 $[Re(NO)Cl_5]^{-2}$
M-9 $[Ir(H_2O)Cl_5]^{-1}$
M-10 $[Re(H_2O)Cl_5]^{-2}$
M-11 $[Rh(H_2O)Br_5]^{-2}$
M-12 $[Ir(H_2O)Br_5]^{-1}$
M-13 $[Os(NO)Cl_5]^{-2}$

The above described metal complex can be added to silver halide during the preparation of silver halide grains.

The metal complex for use in the present invention contains only one nitrosyl, thionitrosyl or aquo ligand. In the silver halide emulsion, generally, not less than 70% of the ligand is contained in the silver halide.

The heavy metal is contained in the silver halide grain of the present invention in an amount of generally from $1\times10^{-7}$ to $1\times10^{-3}$ mol, preferably from $5\times10^{-7}$ to $1\times10^{-4}$ mol, per mol of the silver halide. The above heavy metals may be used in combination of two or more thereof. The distribution of the heavy metal in the silver halide grain is not particularly limited but they are preferably distributed uniformly in the grain.

The addition amount of the selenium compound for use in the present invention varies widely according to various conditions such as the temperature, the grain size of the silver halide grains and the halogen composition, but is preferably from $1\times10^{-7}$ to $5\times10^{-4}$ mol per mol of the silver halide.

The chemical sensitization using the selenium compound for use in the present invention is preferably conducted at a ripening pH of from 4.7 to 6.0 and a ripening pAg of from 7.0 to 8.5 for obtaining the objective photographic characteristics. The ripening temperature is preferably from 50° to 75° C.

In the present invention, a noble metal sensitizer such as gold, platinum, palladium and iridium is preferably used in combination.

A gold sensitizer is particularly preferably used. Examples thereof include chloroauric acid, potassium chloroaurate, potassium aurithiocyanate, gold sulfide, gold selenide, etc. The gold sensitizer can be used in an amount of about from $10^{-7}$ to $10^{-2}$ mol per mol of the silver halide.

Further, a sulfur sensitizer is also preferably used in combination. Specific examples thereof include known unstable sulfur compounds such as thiosulfates (e.g., hypo), thioureas (e.g., diphenylthiourea, triethylurea, allylthiourea), rhodanines, etc. The sulfur sensitizer can be used in an amount of about from $10^{-7}$ to $10^{-2}$ mol per mol of the silver halide.

It is preferred for the silver halide grains of the present invention to contain the thiosulfonic acid compound represented by the following formula (1), (2) or (3) during the grain formation and/or the chemical sensitization. This results in obtaining an emulsion of further lower fog.

$$R—SO_2S—M \quad (1)$$

$$R—SO_2S—R' \quad (2)$$

$$R—SO_2S—L_m—SSO_2—R'' \quad (3)$$

wherein R, R' and R", which may be the same or different, each represents an aliphatic group, an aromatic group or a heterocyclic group; M represents a cation; L represents a divalent linking group; and m represents 0 or 1.

The compounds represented by formulae (1) to (3) for use in the present invention may be a polymer comprising a divalent group derived from the compound represented by formula (1), (2) or (3) as a repeating unit.

Specific examples of the compounds represented by formulae (1) to (3) include Compounds a to k disclosed on pages 17 and 18 of EP-A-514675. The compound represented by formula (1), (2) or (3) is, in general, added in an amount of from $1\times10^{-5}$ to 1 g, preferably from $1\times10^{-4}$ to $1\times10^{-2}$ g, per mol of the silver halide.

The silver halide emulsion of the silver halide photographic material for use in the present invention preferably has an average grain size of 0.20 $\mu$m or less, particularly preferably from 0.08 to 0.16 $\mu$m. When the grain size exceeds 0.2 $\mu$m, $\gamma$ and practical Dmin are reduced. In the present invention, as mixing conditions to adjust silver halide grains, the reaction temperature is generally 50° C. or less, preferably 40° C. or less, and the silver potential is generally 70 mV or more, preferably from 300 mV to 500 mV, under the conditions of sufficiently high agitation rate to attain uniform mixture. Alternatively, a preferred result can be obtained when the adjustment is conducted at the silver potential of from 80 mV to 120 mV in the presence of a stabilizer such as 5,6-cyclopentane-4-hydroxy-1,3,3a,7-tetrazaindene. The grain size distribution is not fundamentally limited but monodisperse is preferred. The term "Monodisperse" used herein means at least 95% of the grains are constituted of the grains having grain sizes within ±40%, preferably ±20%, of the average grain size in terms of weight or grain number. The silver halide grains according to the present invention preferably have a regular crystal form such as a cubic form and an octahedral form, particularly preferably a cubic form.

The silver halide photographic material of the present invention generally further comprises a hydrophilic colloid layer, and the silver halide emulsion layer and/or the hydrophilic colloid layer preferably contains a hydrazine compound and a nucleation accelerator.

The hydrazine compound for use in the present invention is preferably represented by the following formula (I):

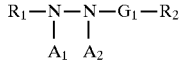

$$R_1—\underset{\underset{A_1}{|}}{N}—\underset{\underset{A_2}{|}}{N}—G_1—R_2 \quad (I)$$

wherein $R_1$ represents an aliphatic or aromatic group; $R_2$ represents a hydrogen atom, an alkyl group, an aryl group, an unsaturated heterocyclic group, an alkoxyl group, an aryloxy group, an amino group or a hydrazino group; $G_1$ represents a —CO— group, an —$SO_2$— group, an —SO— group, a

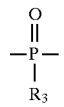

$$—\overset{\overset{O}{\|}}{\underset{\underset{R_3}{|}}{P}}—$$

group, a —CO—CO— group, a thiocarbonyl group or an iminomethylene group; $A_1$ and $A_2$ each represents a hydrogen atom, or either of them represents a hydrogen atom and the other represents a substituted or unsubstituted alkylsulfonyl group, a substituted or unsubstituted arylsulfonyl group or a substituted or unsubstituted acyl group; and $R_3$ has the same meaning as defined in $R_2$ and may be different from $R_2$.

In formula (I), the aliphatic group represented by $R_1$ preferably has from 1 to 30 carbon atoms, and is particularly preferably a straight chain, branched or cyclic alkyl group having from 1 to 20 carbon atoms. Herein, the branched alkyl group may be cyclized to form a saturated heterocyclic ring containing one or more hetero atoms therein. Moreover, this alkyl group may have a substituent.

The aromatic group represented by $R_1$ in formula (I) is a monocyclic or bicyclic aryl group or an unsaturated heterocyclic group. Here, the unsaturated heterocyclic group may be condensed with a monocyclic or bicyclic aryl group to form a heteroaryl group. Examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring or a benzothiazole ring. Of these, those containing a benzene ring are preferred.

$R_1$ is particularly preferably an aryl group.

The aliphatic group or aromatic group represented by $R_1$ may be substituted. Representative substituents include, for example, an alkyl group, an alkenyl group, an alkynyl group, an aryl group, a group containing a heterocyclic ring, a pyridinium group, a hydroxyl group, an alkoxyl group, an aryloxy group, an acyloxy group, an alkyl- or arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkyl- or arylthio group, an alkyl- or arylsulfonyl group, an alkyl- or arylsulfinyl group, a carboxyl group, a sulfo group, an acyl group, an alkoxy- or aryloxycarbonyl group, a carbamoyl group, a sulfamoyl group, a halogen atom, a cyano group, a phosphoric acid amido group, a diacylamino group, an imido group, a group having an acylurea structure, a group containing a selenium atom or a tellurium atom, and a group having a tertiary or quaternary sulfonium structure, and preferred substituents include a straight chain, branched or cyclic alkyl group (preferably having from 1 to 20 carbon atoms), an aralkyl group (preferably monocyclic or bicyclic and the alkyl moiety of which has from 1 to 3 carbon atoms), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphoric acid amido group (preferably having from 1 to 30 carbon atoms).

The alkyl group represented by $R_2$ in formula (I) is preferably an alkyl group having from 1 to 4 carbon atoms, and the aryl group represented by $R_2$ in formula (I) is preferably a monocyclic or bicyclic aryl group, for example, an aryl group which contains a benzene ring.

The unsaturated heterocyclic group is a 5- or 6-membered compound containing at least one nitrogen, oxygen or sulfur atom. Example thereof include an imidazolyl group, a pyrazolyl group, a triazolyl group, a tetrazolyl group, a pyridyl group, a pyridinium group, a quinolinium group or a quinolinyl group. A pyridyl group and a pyridinium group are particularly preferred.

The alkoxyl group is preferably an alkoxyl group having from 1 to 8 carbon atoms, the aryloxy group is preferably a monocyclic aryloxy group, the amino group is preferably an unsubstituted amino group, an alkylamino group having from 1 to 10 carbon atoms and an arylamino group.

$R_2$ may be substituted, and groups cited as a substituent for $R_1$ are applied to preferred substituent examples for $R_2$.

When $G_1$ represents a —CO— group, preferred groups represented by $R_2$ include a hydrogen atom, an alkyl group (e.g., methyl, monofluoromethyl, difluoromethyl, trifluoromethyl, 3-hydroxypropyl, 3-methanesulfonamidopropyl, phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl).

Further, when $G_1$ represents an —$SO_2$— group, preferred groups represented by $R_2$ include an alkyl group (e.g., methyl), an aralkyl group (e.g., o-hydroxybenzyl), an aryl group (e.g., phenyl), and a substituted amino group (e.g., dimethylamino).

When $G_1$ represents a —COCO— group, $R_2$ preferably represents an alkoxyl group, an aryloxy group or an amino group.

$G_1$ in formula (I) preferably represents a —CO— group or a —COCO— group, and most preferably a —CO— group.

Further, $R_2$ may be such a group as to cleave the —$G_1$—$R_2$ moiety from the remainder of the molecule and generate a cyclization reaction to form a ring structure containing the atoms of the —$G_1$—$R_2$ moiety. Examples thereof include those disclosed in JP-A-63-29751 (corresponding to U.S. Pat. No. 4,798,780).

$A_1$ and $A_2$ each represents a hydrogen atom, an alkyl- or arylsulfonyl group having 20 or less carbon atoms (preferably phenylsulfonyl, or substituted phenylsulfonyl having a total Hammett's substituent constant of −0.5 or more), an acyl group having 20 or less carbon atoms (preferably benzoyl or substituted benzoyl having a total Hammett's substituent constant of −0.5 or more, or straight chain, branched or cyclic, substituted or unsubstituted aliphatic acyl (examples of the substituents include, e.g., a halogen atom, an ether group, a sulfonamido group, a carbonamido group, a hydroxyl group, a carboxyl group, a sulfonic acid group)).

$A_1$ and $A_2$ most preferably represent a hydrogen atom.

The substituents represented by $R_1$ and $R_2$ in formula (I) may further be substituted and preferred substituents include those exemplified as the substituent for $R_1$.

$R_1$ or $R_2$ in formula (I) may include a ballast group or a polymer, which is normally used in immobile photographic additives such as couplers, incorporated therein. Such a ballast group has 8 or more carbon atoms and is a group which is photographically comparatively inactive. Such a group can be selected from, for example, an alkyl group, an aralkyl group, an alkoxyl group, a phenyl group, an alkylphenyl group, a phenoxy group or an alkylphenoxy group. Further, examples of the polymer include those disclosed, for example, in JP-A-1-100530.

$R_1$ or $R_2$ in formula (I) may include a group which enhances adsorptivity thereof onto the surface of the silver halide grains. Examples of such an adsorptive group include an alkylthio group, an arylthio group, a thiourea group, a heterocyclic thioamido group, a mercapto heterocyclic group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The preferred hydrazine compound for use in the present invention is a hydrazine compound in which $R_1$ represents a phenyl group having a ballast group a group which accelerates adsorptivity onto the surface of silver halide grains, a group having a quaternary ammonium structure, or an alkylthio group, via a sulfonamido group, an acylamino group or a ureido group; $G_1$ represents a —CO— group; and $R_2$ represents a hydrogen atom, a substituted alkyl group or a substituted aryl group (preferred examples of the substituent include an electron attractive group or a hydroxymethyl group to be substituted at the 2-position). In addition, any combinations of the selection from the above $R_1$ and $R_2$ are possible and preferred.

Further, a hydrazine derivative having, in the vicinity of the hydrazine group, an anionic group or a nonionic group which forms an intramolecular hydrogen bond with the hydrogen atom of the hydrazine is particularly preferably used in the present invention.

Specifically, carboxylic acid, sulfonic acid, sulfinic acid, phosphoric acid, phosphonic acid and the salts of these acids can be exemplified as the anionic group. Herein, the phrase "in the vicinity of the hydrazine group" means that a bonding chain formed by 2 to 5 atoms comprising at least one kind of atoms selected from a carbon atom, a nitrogen atom, an oxygen atom and a sulfur atom intervenes between the nitrogen atom that is near the anionic group of the hydrazine, and the anionic group.

More preferred as "the vicinity" is the case where a bonding chain formed by 2 to 5 atoms comprising at least one kind of atoms selected from a carbon atom and a nitrogen atom intervenes therebetween, and still more preferred is the case where a bonding chain formed by 2 or 3 carbon atoms intervenes therebetween. The nonionic group which forms an intramolecular hydrogen bond with the hydrogen atom of the hydrazine is a group which forms a hydrogen bond with the hydrogen atom of the hydrazine by the action of its lone pair to form a 5- to 7-membered ring, and has at least one oxygen, nitrogen, sulfur or phosphorus atom. Examples of such nonionic groups include an alkoxyl group, an amino group, an alkylthio group, a carbonyl group, a carbamoyl group, an alkoxycarbonyl group, a urethane group, a ureido group, an acyloxy group and an acylamino group.

Of these, an anionic group is preferred, and carboxylic acid and the salt thereof are most preferred.

A nucleating agent preferably used in the present invention is represented by the following formula (II), (III) or (IV):

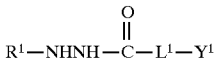

(II)

wherein $R^1$ represents an alkyl group, an aryl group or a heterocyclic group; $L^1$ represents a divalent linking group having an electron attractive group; and $Y^1$ represents an anionic group or a nonionic group which forms an intramolecular hydrogen bond with the hydrogen atom of the hydrazine;

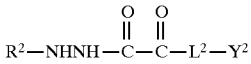

(III)

wherein $R^2$ represents an alkyl group, an aryl group or a heterocyclic group; $L^2$ represents a divalent linking group; and $Y^2$ represents an anionic group or a nonionic group which forms an intramolecular hydrogen bond with the hydrogen atom of the hydrazine;

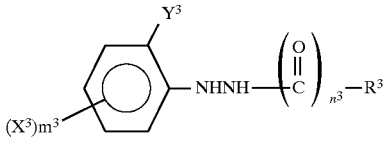

(IV)

wherein $X^3$ represents a group capable of substitution on a benzene ring; $R^3$ represents an alkyl group, an alkenyl group, an alkynyl group, an aryl group, a heterocyclic group, an alkoxyl group or an amino group; $Y^3$ represents an anionic group or a nonionic group which forms an intramolecular hydrogen bond with the hydrogen atom of the hydrazine; $m^3$ represents an integer of 0 to 4; and $n^3$ is 1 or 2, and when $n^3$ is 1, $R^3$ has an electron attractive group.

Formulae (II), (III) and (IV) are described further in detail.

The alkyl group represented by $R^1$ and $R^2$ is a straight chain, branched or cyclic alkyl group having from 1 to 16, preferably from 1 to 12, carbon atoms, e.g., methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl or 2-acetamidoethyl.

The aryl group represented by $R^1$ and $R^2$ is an aryl group having from 6 to 24, preferably from 6 to 12, carbon atoms, e.g., phenyl, naphthyl, p-alkoxyphenyl, p-sulfonamidophenyl, p-ureidophenyl or p-amidophenyl. The heterocyclic group represented by $R^1$ and $R^2$ is a saturated or unsaturated 5- or 6-membered heterocyclic ring having from 1 to 5 carbon atoms and containing one or more of an oxygen atom, a nitrogen atom or a sulfur atom, and the number and kind of the hetero atom constituting the ring may be one or more, e.g., 2-furyl, 2-thienyl or 4-pyridyl.

$R^1$ and $R^2$ preferably represent an aryl group, an aromatic heterocyclic group or a methyl group substituted with an aryl group, more preferably an aryl group (e.g., phenyl, naphthyl). $R^1$ and $R^2$ may be substituted with substituents and examples of the substituents include, for example, an alkyl group, an aralkyl group, an alkoxyl group, an amino group substituted with an alkyl or aryl group, an amido group, a sulfonamido group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group, a carboxyl group, and a phosphoric acid amido group. These groups may further be substituted. Of the above groups, a sulfonamido group, a ureido group, an amido group, an alkoxyl group and a urethane group are preferred, and a sulfonamido group and a ureido group are more preferred. These groups may be linked with each other to form a ring, if possible.

Examples of the alkyl group, aryl group and heterocyclic group represented by $R^3$ include those exemplified as $R^1$. The alkenyl group represents an alkenyl group having from 2 to 18, preferably from 2 to 10, carbon atoms, e.g., vinyl and 2-styryl. The alkynyl group represents an alkynyl group having from 2 to 18, preferably from 2 to 10, carbon atoms, e.g., ethynyl and phenylethynyl. The alkoxyl group represents a straight chain, branched or cyclic alkoxyl group having from 1 to 16, preferably from 1 to 10, carbon atoms, e.g., methoxy, isopropoxy, and benzyloxy. The amino group represents an amino group having from 0 to 16, preferably from 1 to 10, carbon atoms, e.g., ethylamino, benzylamino and phenylamino.

When $n^3$ is 1, $R^3$ preferably represents an alkyl group, an alkenyl group or an alkynyl group, and when $n^3$ is 2, $R^3$ preferably represents an amino group or an alkoxyl group.

The electron attractive group which may present in $R^3$ is those having a Hammett's $\sigma_m$ value of 0.2 or more, preferably 0.3 or more. Examples thereof include a halogen atom (fluorine, chlorine, bromine), a cyano group, a sulfonyl group (e.g., methanesulfonyl, benzenesulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), an alkyl group substituted with a halogen atom (e.g., trifluoromethyl), a heterocyclic group (e.g., 2-benzoxazolyl, pyrrolo), or a quaternary onium group (e.g., triphenylphosphonium, trialkylammonium, pyridinium). Examples of $R^3$ having an electron attractive group include trifluoromethyl, difluoromethyl, monofluoromethyl, pentafluoroethyl, cyanomethyl, methanesulfonylmethyl, acetylethyl, trifluoromethylethynyl and ethoxycarbonylmethyl.

$L^1$ and $L^2$ represent a divalent linking group, e.g., an alkylene group, an alkenylene group, an alkynylene group, an arylene group, a divalent heterocyclic group or a group formed by linking these groups with —O—, —S—, —NH—, —CO— or —$SO_2$—, or with two or more thereof in combination. $L^1$ and $L^2$ may be substituted with a group exemplified as the substituent for $R^1$. The alkylene group represents, e.g., methylene, ethylene, trimethylene, propylene, 2-buten-1,4-yl, or 2-butyn-1,4-yl. The alkenylene group represents, e.g., vinylene. The alkynylene group represents, e.g., ethynylene. The arylene group represents, e.g., phenylene. The divalent heterocyclic group represents, e.g., furan-1,4-diyl. $L^1$ preferably represents an alkylene group, an alkenylene group, an alkynylene group or arylene group, more preferably an alkylene group, and an alkylene group having a chain length of 2 or 3 carbon atoms is most preferred. $L^2$ preferably represents an alkylene group, an arylene group, —NH-alkylene-, —O-alkylene- or —NH-arylene-, and more preferably —NH-alkylene- or —O-alkylene-.

The electron attractive group described for $R^3$ can be applied to the electron attractive group represented by $L^1$. Examples of $L^1$ include tetrafluoroethylene, fluoromethylene, hexafluorotrimethylene, perfluorophenylene, difluorovinylene, cyanomethylene and methanesulfonylethylene.

$Y^1$, $Y^2$ and $Y^3$, which have already been described, represent an anionic group or a nonionic group which forms a hydrogen bond with the hydrogen atom of the hydrazine by the action of its lone pair to form a 5- to 7-membered ring. Specific examples of the anionic group include carboxylic acid, sulfonic acid, sulfinic acid, phosphoric acid, phosphonic acid and the salts of these acids. Examples of the salts include an alkali metal ion (e.g., sodium, potassium), an alkaline earth metal ion (e.g., calcium, magnesium), ammonium (e.g., ammonium, triethylammonium, tetrabutylammonium, pyridinium) and phosphonium (tetraphenylphosphonium). The nonionic group is a group which has at least one oxygen, nitrogen, sulfur or phosphorus atom. Examples thereof include an alkoxyl group, an amino group, an alkylthio group, a carbonyl group, a carbamoyl group, an alkoxycarbonyl group, a urethane group, a ureido group, an acyloxy group and an acylamino group. $Y^1$, $Y^2$ and $Y^3$ preferably represent an anionic group, more preferably a carboxylic acid and the salt thereof.

Examples of the group capable of substitution on a benzene ring represented by $X^3$ and preferred examples thereof include the substituents for $R^1$ in formula (II). When $m^3$ is 2 or more, a plurality of $X^3$ may be the same or different.

$R^1$, $R^2$, $R^3$ and $X^3$ may contain a nondiffusible group used in photographic couplers or may contain a group which accelerates adsorptivity onto silver halide. The nondiffusible group is a group having from 8 to 30, preferably from 12 to 25, carbon atoms. Preferred examples of the group which accelerates adsorptivity onto silver halide include thioamidos (e.g., thiourethane, thioureido, thioamido), mercaptos (e.g., heterocyclic mercapto such as 5-mercaptotetrazole, 3-mercapto-1,2,4-triazole, 2-mercapto-1,3,4-thiadiazole and 2-mercapto-1,3,4-oxadiazole, alkylmercapto, arylmercapto) and a 5- or 6-membered nitrogen-containing heterocyclic ring (e.g., benzotriazole) which forms imino silvers. The group having a group which accelerates adsorptivity onto the silver halide may have such a structure that the adsorptive group is protected and the protective group is removed at the time of development processing to enhance the adsorptivity onto silver halide.

In formulae (II), (III) and (IV), radicals generated by eliminating hydrogen atoms from each two compounds may be bonded to form a bis-type compound.

Of formulae (II), (III) and (IV), formulae (II) and (III) are preferred, and formula (II) is more preferred. Further, formulae (II), (III) and (IV) are more preferably represented by formulae (V), (VI) and (VII). Of these, formula (V) is most preferred.

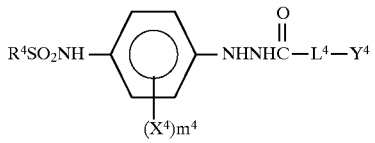

(V)

wherein $R^4$, $X^4$ and $m^4$ have the same meaning as $R^3$, $X^3$ and $m^3$ in formula (IV), respectively, and $L^4$ and $Y^4$ have the same meaning as $L^1$ and $Y^1$ in formula (II), respectively.

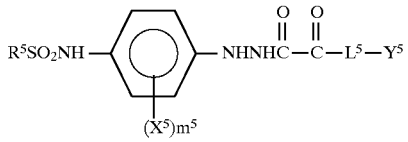

(VI)

wherein $R^5$, $X^5$ and $m^5$ have the same meaning as $R^3$, $X^3$ and $m^3$ in formula (IV), respectively, and $L^5$ and $Y^5$ have the same meaning as $L^2$ and $Y^2$ in formula (III), respectively.

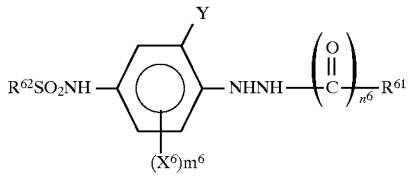

(VII)

wherein $R^{61}$, $R^{62}$, $X^6$, $m^6$, $n^6$ and Y have the same meaning as $R^3$, $R^3$, $X^3$, $m^3$, $n^3$ and $Y^3$ in formula (IV), respectively.

In the present invention, the above-described hydrazine compound having, in the vicinity of the hydrazine group, an anionic group or a nonionic group which forms an intramolecular hydrogen bond with the hydrogen atom of the hydrazine is also preferably used in combination with a hydrazine compound in which $R^1$ represents a hydrogen atom.

Specific examples of the hydrazine compounds for use in the present invention are shown below, but the present invention is not limited thereto.

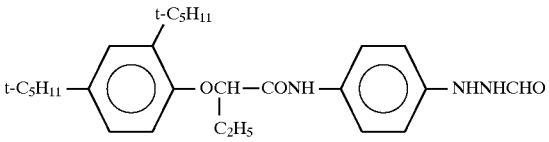

I-1

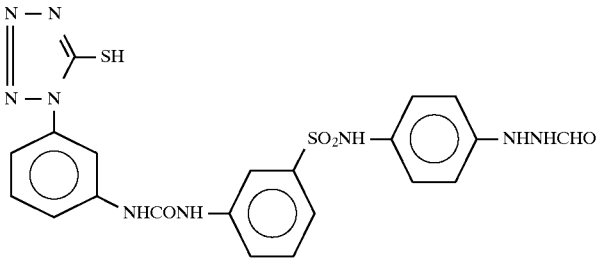

I-2

-continued
I-3
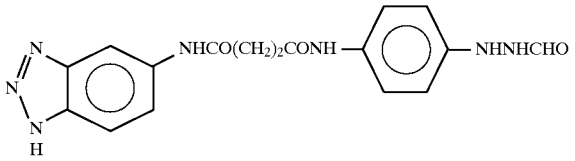
I-4
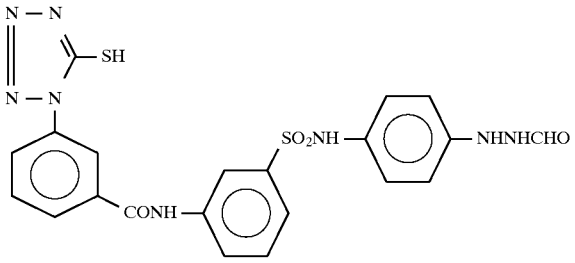
I-5
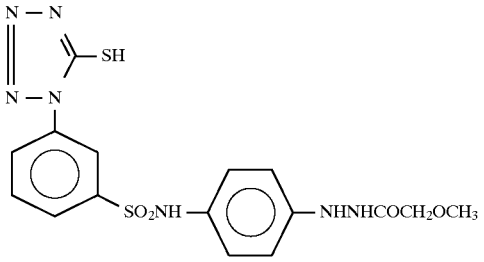
I-6
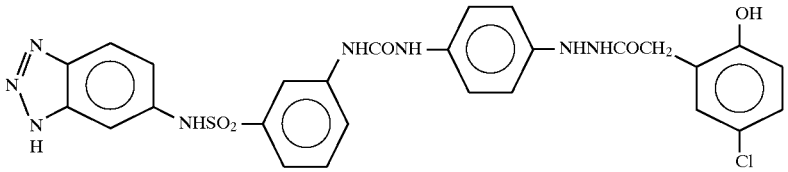
I-7
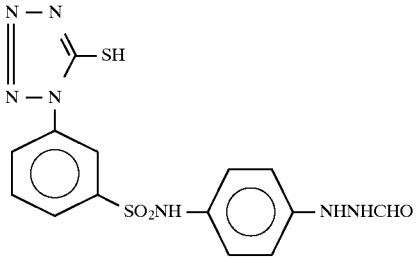
I-8
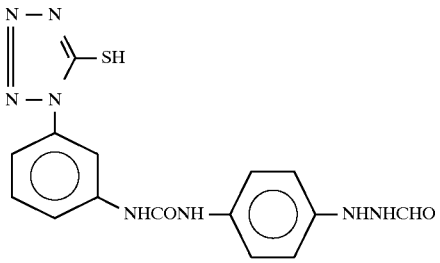
I-9
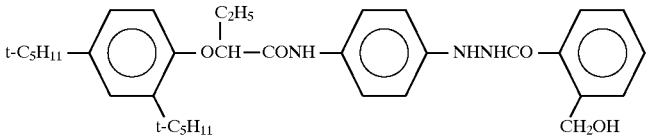

-continued
I-10
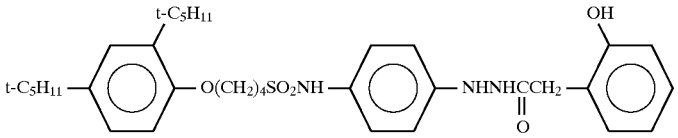
I-11
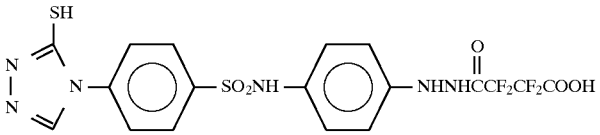
I-12
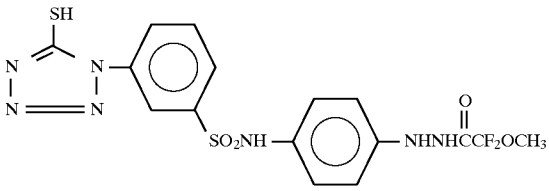
I-13
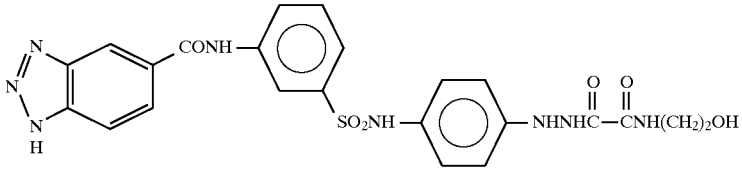
I-14
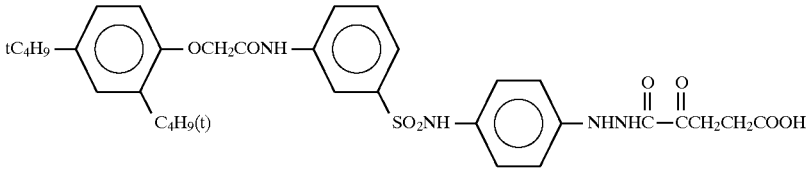
I-15
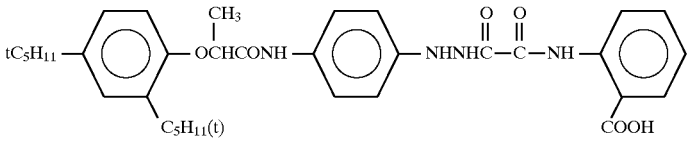
I-16
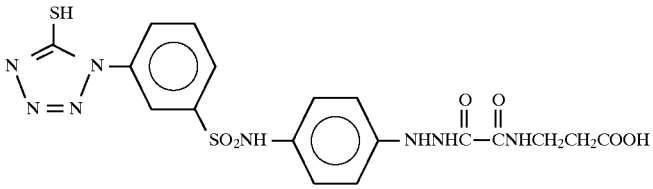
I-17
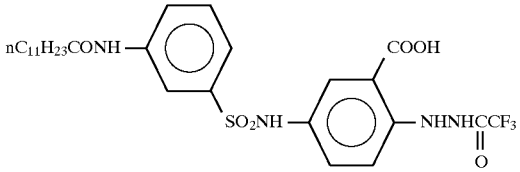
I-18
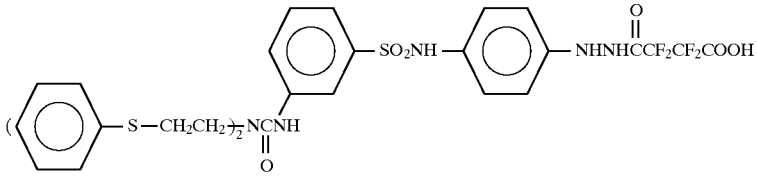

-continued
I-19
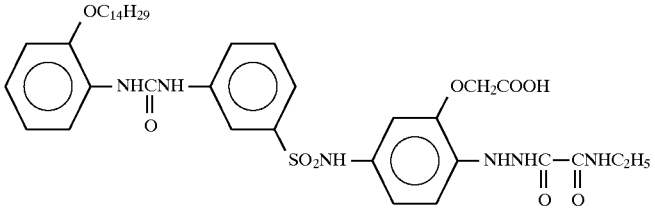
I-20
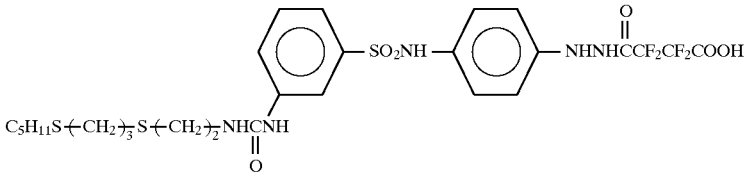
I-21
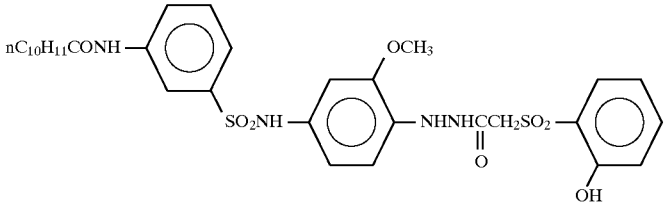
I-22
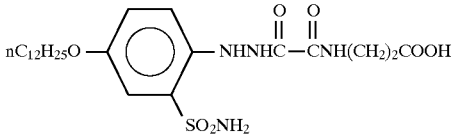
I-23
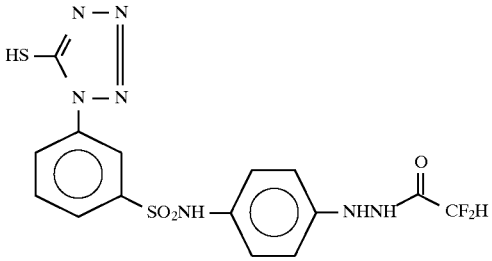
I-24
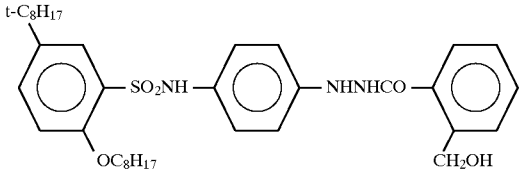
I-25
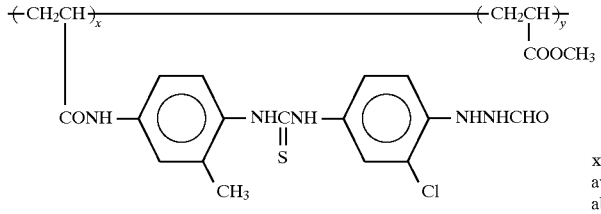
x/y = 3/97
average molecular weight:
about 100,000
I-26
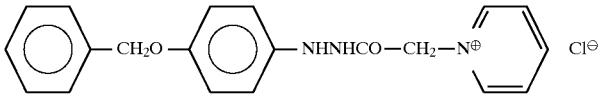
I-27
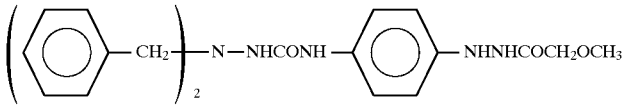

-continued
I-28
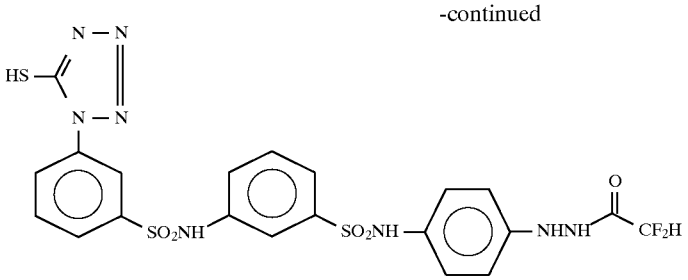
I-29
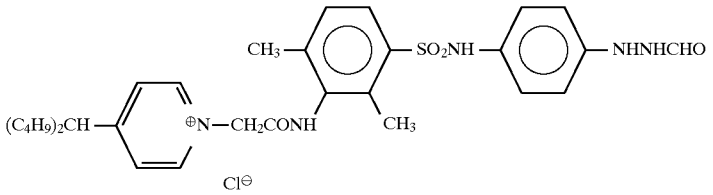
I-30
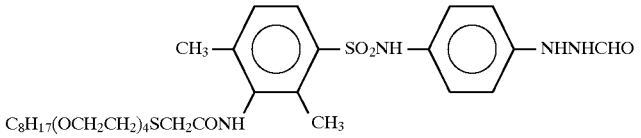
I-31
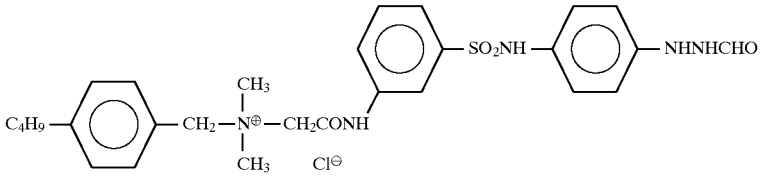
I-32
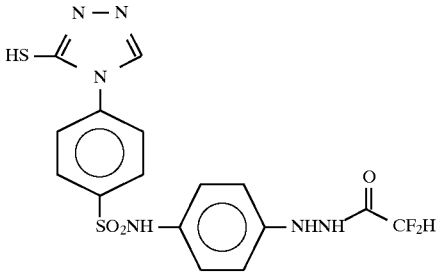
I-33
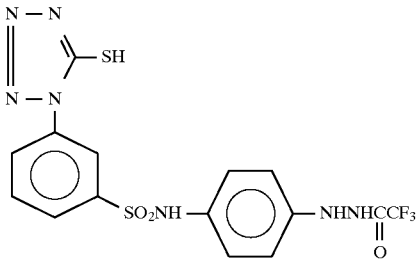
I-34
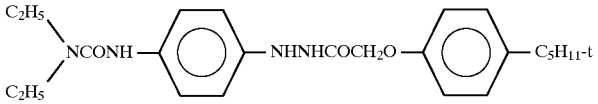
I-35
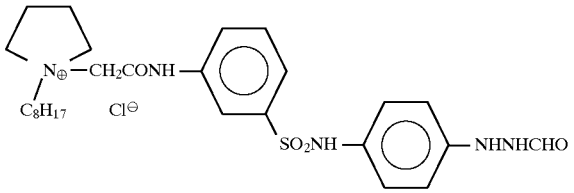

-continued
I-36
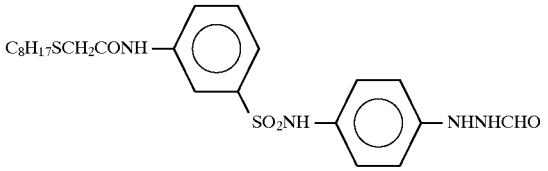
I-37
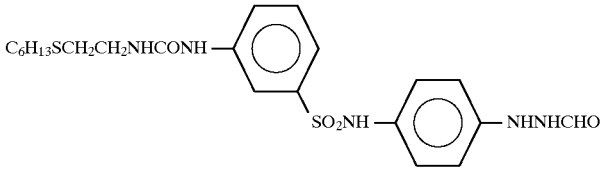
I-38
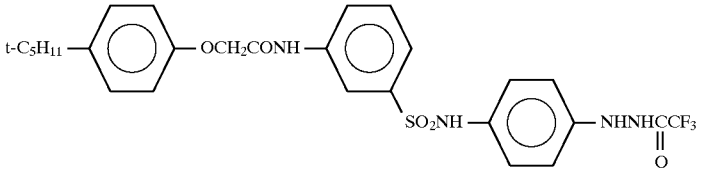
I-39
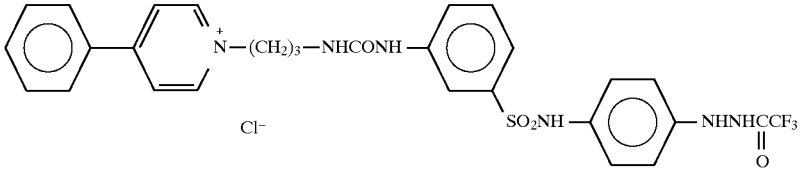
I-40
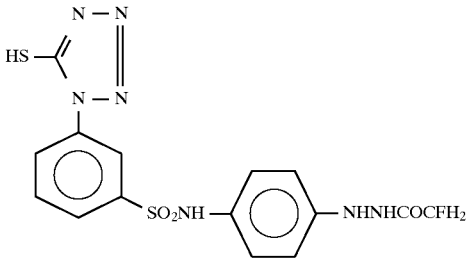
I-41
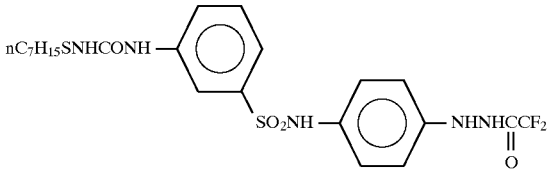
I-42
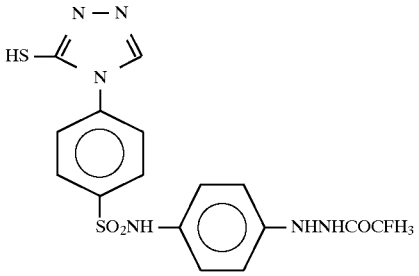
I-43
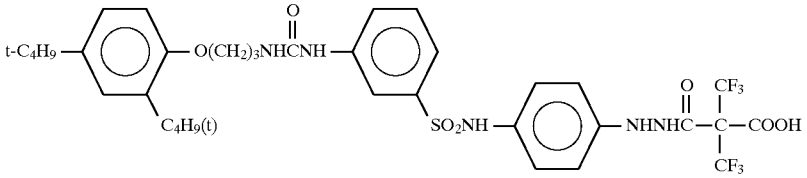

-continued
I-44
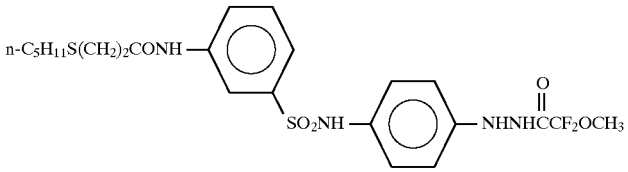
I-45
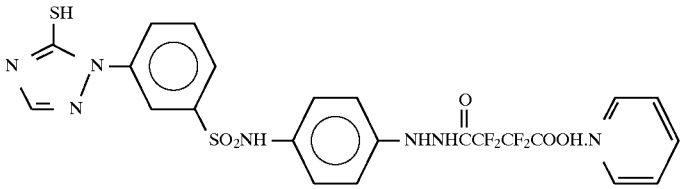
I-46
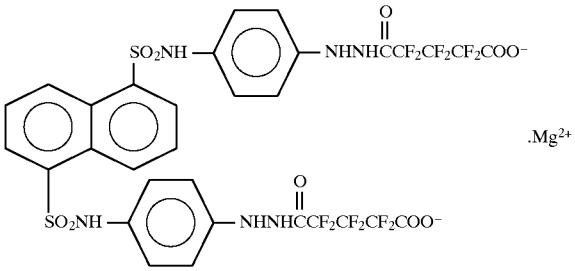
I-47
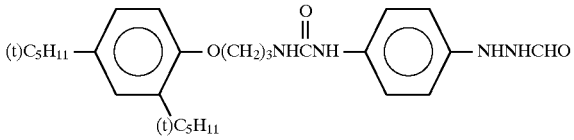
I-48
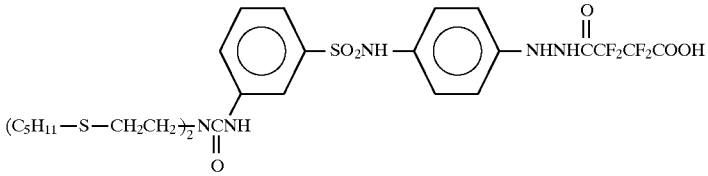
I-49
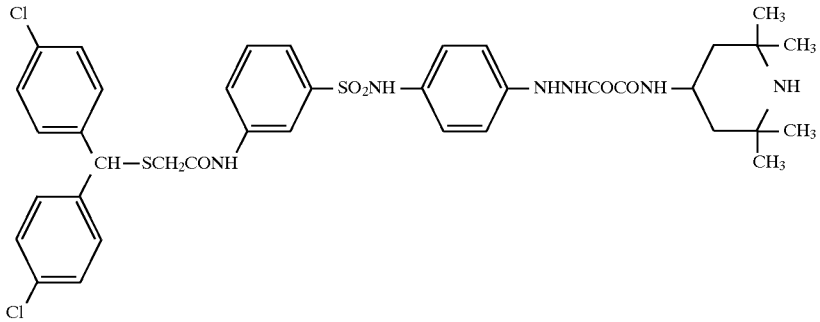
I-50
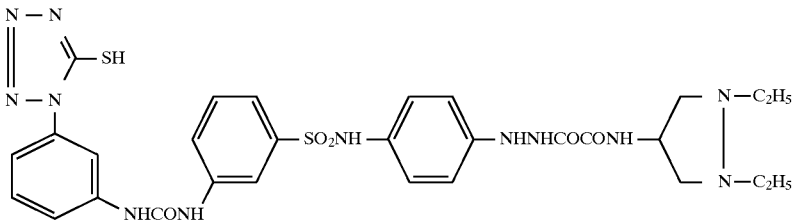

-continued
I-51
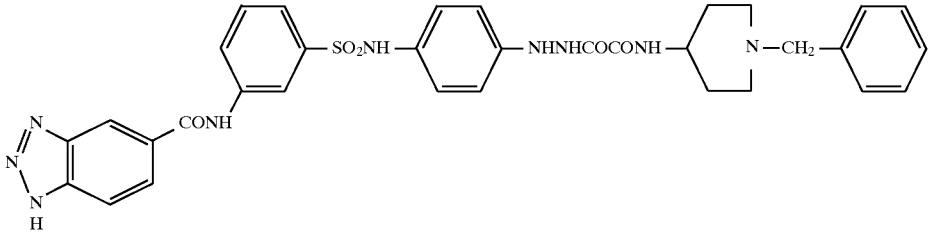
I-52
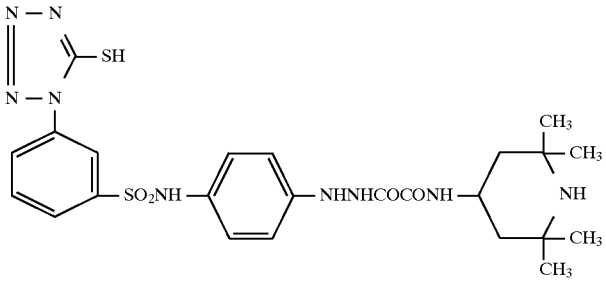
I-53
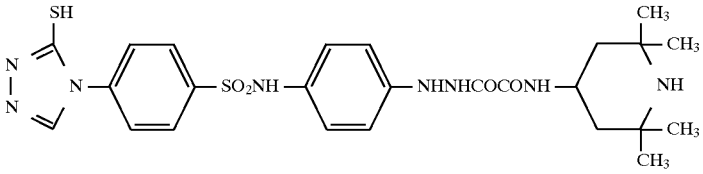
I-54
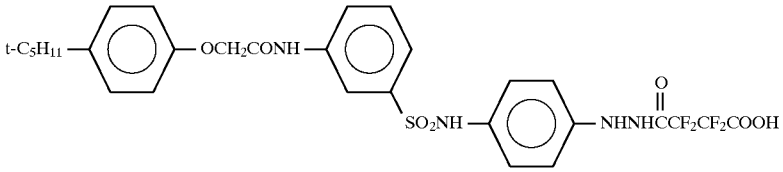
I-55
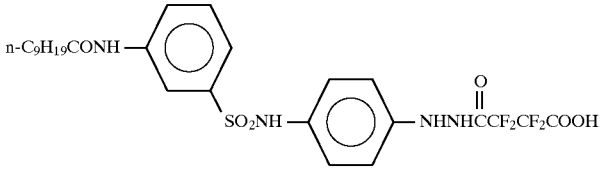
I-56
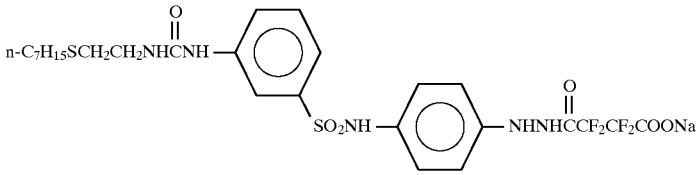
I-57
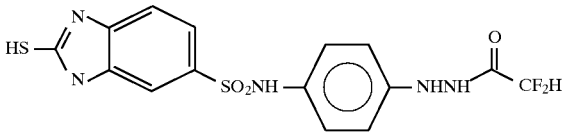
I-58
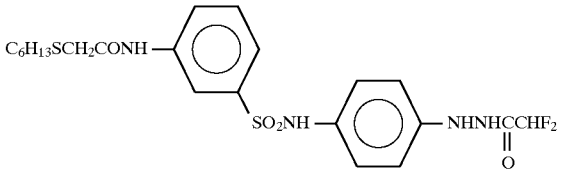

-continued

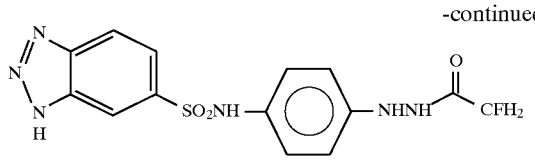

I-59

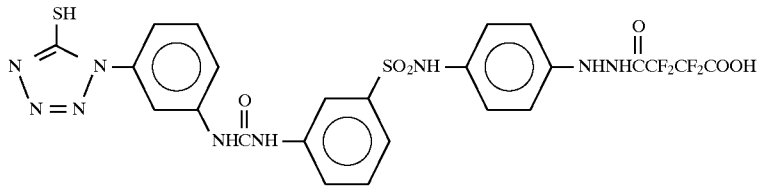

I-60

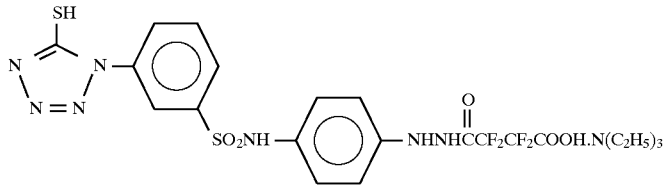

I-61

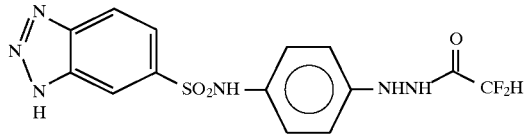

I-62

In addition to the compounds shown above, examples of the hydrazine compound which can be used in the present invention include those disclosed in *Research Disclosure*, Item 23516 (November, 1983), p. 346, and the literature cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, 5,104,769, British Patent 2,011,391B, EP 217310, EP 301799, EP 356898, JP-A-60-179734, JP-A-61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764, JP-A-5-45765 and JP-A-6-289524.

The amount of hydrazine compound for use in the present invention is preferably from $1\times10^{-6}$ mol to $5\times10^{-2}$ mol, and particularly preferably from $1\times10^{-5}$ mol to $2\times10^{-2}$ mol, per mol of the silver halide.

The hydrazine compound for use in the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide and methyl cellosolve.

Further, other methods can be utilized for the inclusion of the hydrazine compound, such as the well-known emulsification dispersion method which comprises dissolving a hydrazine compound using an oil (e.g., dibutyl phthalate, tricresyl phosphate, glyceryl triacetate and diethyl phthalate) and an auxiliary solvent (e.g., ethyl acetate and cyclohexanone), and mechanically dispersing to prepare an emulsified dispersion, or a known solid dispersion method in which powder of a hydrazine compound is dispersed in water using a ball mill, a colloid mill or ultrasonic wave.

Further, the hydrazine compound may be incorporated in polymer fine grains as disclosed in JP-A-2-948 (corresponding to U.S. Pat. No. 4,985,338).

The nucleation accelerator is preferably contained in at least one layer of emulsion layers or other hydrophilic colloid layers of the silver halide photographic material according to the present invention.

The nucleation accelerator preferably used in the present invention is a compound represented by the following formula (8), (9), (10) or (11):

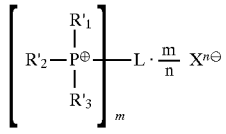

(8)

wherein $R'_1$, $R'_2$ and $R'_3$ each represents an alkyl group, a cycloalkyl group, an aryl group, an alkenyl group, a cycloalkenyl group or a heterocyclic group, and these groups may further be substituted; m represents an integer of 1, 2, 3 or 4; L represents an m-valent organic group bonded with a P atom via a carbon atom thereof; n represents an integer of 1, 2 or 3; and X represents an n-valent anion, and X may be linked with L.

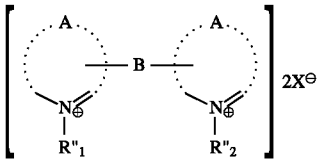

(9)

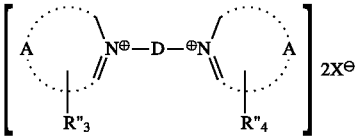

(10)

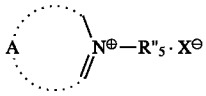

(11)

wherein A represents an organic group for completing a heterocyclic ring; B and D each represents a divalent group; $R''_1$ and $R''_2$ each represents an alkyl group or an aryl group; $R''_3$ and $R''_4$ each represents a hydrogen atom or a substituent; $R''_5$ represents an alkyl group; and X represents an anionic group, but when the compound forms an inner salt, X doe not exist.

Details of the compounds represented by formulae (8), (9), (10) and (11) are described in JP-A-8-95183 (corresponding to U.S. Ser. No. 08/530755 filed on Sep. 19, 1995), and Compounds A201 to A262 disclosed therein can be enumerated as examples of the compound.

Many of the compounds represented by formula (8) are known and commercially available as a reagent. A general synthesis method of the compound represented by formula (8) is a method in which phosphinic acids are reacted with an alkylating agent such as alkyl halides or sulfonates, or a method in which the counter anions of phosphonium salts are exchanged by an ordinary method.

The compounds represented by formulae (9), (10) and (11) can easily be synthesized according to a generally known method. In this regard, for example, *Quart. Rev.*, 16, 163 (1962), can be referred to.

The addition amount of the compounds represented by formulae (8), (9), (10) and (11) are not particularly limited, but is preferably from $1\times10^{-5}$ to $2\times10^{-2}$ mol, particularly preferably from $2\times10^{-5}$ to $1\times10^{-2}$ mol, per mol of the silver halide.

The nucleation accelerator is particularly preferably a compound represented by formula (10).

The compounds represented by formulae (8), (9), (10) and (11) are suitably added to a silver halide emulsion solution or a hydrophilic colloid solution in the form of aqueous solution in case that the compound is water-soluble, or in the form of a solution of an organic solvent miscible with water such as alcohols (e.g., methanol, ethanol), esters (e.g., ethyl acetate) or ketones (e.g., acetone) in case that the compound is water-insoluble, to thereby incorporate the compound into the photographic material.

Further, other methods can be utilized for the inclusion of the compounds into the photographic material, such as a well-known emulsification dispersion method which comprises dissolving the compound using an oil (e.g., dibutyl phthalate, tricresyl phosphate, glyceryl triacetate and diethyl phthalate) and an auxiliary solvent (e.g., ethyl acetate and cyclohexanone), and mechanically dispersing to prepare an emulsified dispersion, or a known solid dispersion method to prepare a fine dispersion.

Specific examples of the nucleation accelerator include, for example, compound IV-1 to IV-29 disclosed in JP-A-62-250439, compounds 1 to 29 disclosed in JP-A-5-273710, compounds II-1 to II-17 disclosed in U.S. Pat. No. 4,847,180, and compounds A-1 to A-47, B-1 to B-21 and C-1 to C-20 disclosed in JP-A-7-234473.

Gelatin is used as a binder for the silver halide emulsion layer and other hydrophilic colloid layers of the present invention, but other hydrophilic colloids can also be used in combination. Examples thereof include proteins such as gelatin derivatives, graft polymers of gelatin and other polymers, albumin and casein; cellulose derivatives such as hydroxyethyl cellulose, carboxymethyl cellulose and cellulose sulfate; sugar derivatives such as sodium alginate and starch derivatives; and various kinds of synthetic hydrophilic homopolymers or copolymers, such as polyvinyl alcohol, partially acetalated polyvinyl alcohol, poly-N-vinylpyrrolidone, polyacrylic acid, polymethacrylic acid, polyacrylamide, polyvinylimidazole and polyvinylpyrazole.

As the gelatin, acid-processed gelatin can be used as well as lime-processed gelatin, and hydrolytic dispersions and decomposed products of gelatin with an enzyme can also be used.

In the present invention, with respect to the coating amount of gelatin as a binder, the gelatin amount of all the hydrophilic colloid layers on the side of the support on which the silver halide emulsion layer is provided is generally 3 $g/m^2$ or less, preferably from 1.0 to 2.3 $g/m^2$, and the total gelatin amount of all the hydrophilic colloid layers on the side of the support on which silver halide emulsion layers are provided and all the hydrophilic colloid layers on the opposite side of the support is generally 6 $g/m^2$ or less, preferably from 2.0 to 6.0 $g/m^2$.

A polymer latex is added to the photographic material for improving dimensional stability and film strength when coating is carried out in a reduced amount of gelatin. Examples of the polymer latex include, for example, polymer latexes comprising various monomers such as alkyl acrylate and alkyl methacrylate as disclosed in U.S. Pat. Nos. 2,763,625, 2,852,382, JP-A-64-538, JP-A-62-115152, JP-A-5-66512, JP-A-5-80449, JP-B-60-15935 (the term "JP-B" as used herein means an "examined Japanese patent publication"), JP-B-4-64058 and JP-B-5-45014, and polymer latexes obtained by copolymerizing a monomer having an active methylene group with a monomer such as alkyl acrylate as disclosed in JP-B-45-5819, JP-B-46-22507, JP-A-50-73625, JP-A-7-152112 and JP-A-8-137060.

Particularly preferred are polymer latexes having a core/shell structure in which the shell part comprises a repeating unit comprising an ethylenically unsaturated monomer containing an active methylene group. Either or both of the core part and the shell part generally has a glass transition point (Tg) of 50° C. or less. Preferably, the Tg of the core part is lower than the Tg of the shell part. More preferably, the Tg of the core part is less than 0° C. (the lower limit is −110° C.) and the Tg of the shell part is 0° C. or more (the upper limit is 150° C.).

A Tg of polymers is described in detail, for example, in J. Brandrup and E. H. Immergut, *Polymer Handbook*, 2nd Edition, III-139 to III-192 (1975), and a Tg of a copolymer can be obtained according to the following equation:

$$\frac{1}{Tg} = \frac{a_1}{Tg_1} + \frac{a_2}{Tg_2} + \ldots + \frac{a_n}{Tg_n}$$

wherein, $Tg_n$: Tg of a homopolymer of monomer n $a_n$: weight fraction of monomer n in a copolymer; and further, $a_1+a_2+ \ldots +a_n=1$.

The polymer latex having a core/shell structure containing an active methylene group in the shell part can improve characteristics such as brittleness, dimensional stability and difficulty in adhesion of photographic materials each other, without reducing wet film strength. Further, improvement of shear stability of the latex per se can be obtained.

Specific examples of the latex are shown below but the present invention is not limited thereto. The copolymerization composition ratio and the core/shell ratio in each polymer are shown in weight percent ratio.

K-1

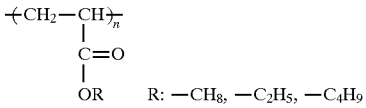

K-2

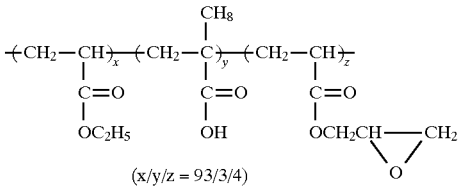

(x/y/z = 93/3/4)

K-3

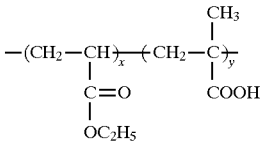

(x/y = 93/7)

K-4

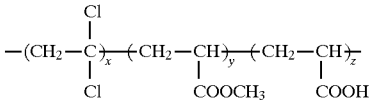

x/y/z = 85/13/2

K-5

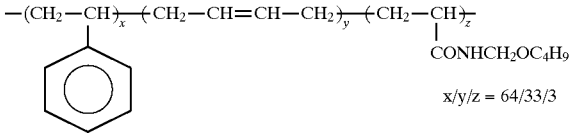

x/y/z = 64/33/3

K-6

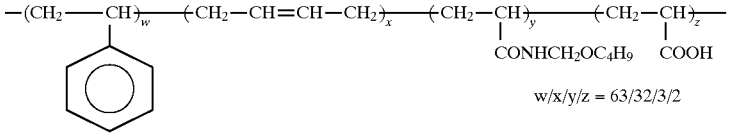

w/x/y/z = 63/32/3/2

K-7

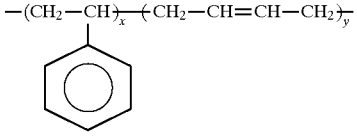

x/y = 67/33

K-8

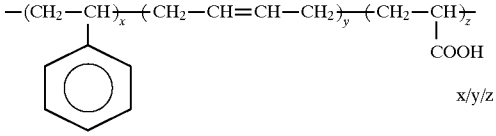

x/y/z = 59/39/2

K-9

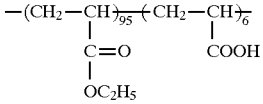

K-10

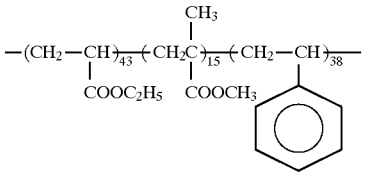

-continued

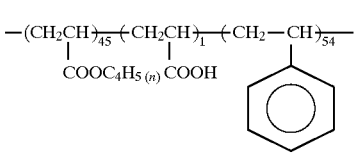

K-11

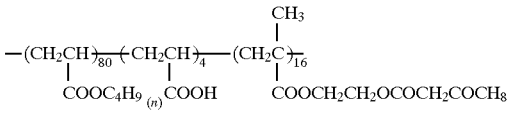

K-12

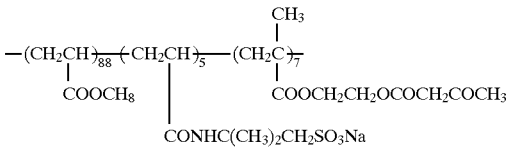

K-13

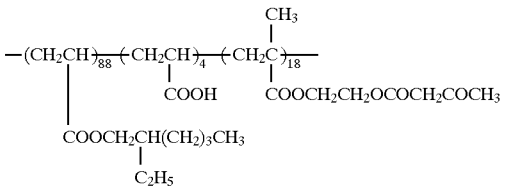

K-14

K-15 to 17 Core: styrene/butadiene copolymer (37/63)

K-15 Shell: styrene/2-acetoacetoxyethyl methacrylate (84/16) core/shell=50/50

K-16 Shell: n-butyl acrylate/2-acetoacetoxyethyl methacrylate (84/16) core/shell=50/50

K-17 Shell: methyl acrylate/styrene/2-acetoacetoxyethyl methacrylate (63/21/16) core/shell=50/50

K-18 and 19 Core: polybutadiene homopolymer (100)

K-18 Shell: styrene/2-acetoacetoxyethyl methacrylate (84/16) core/shell=50/50

K-19 Shell: ethyl acrylate/2-acetoacetoxyethyl methacrylate/methacrylic acid (65/15/20) core/shell=75/25

K-20 and 21 Core: ethylene glycol dimethacrylate/n-butyl acrylate copolymer (20/80)

K-20 Shell: styrene/2-acetoacetoxyethyl methacrylate (84/16) core/shell=50/50

K-21 Shell: methyl acrylate/sodium 2-acrylamido-2-methylpropanesulfonate/2-acetoacetoxyethyl acrylate (80/4/16) core/shell=50/50

K-22 and 23 Core: divinylbenzene/2-ethylhexyl acrylate copolymer (10/90)

K-22 Shell: methyl acrylate/2-acetoacetoxyethyl methacrylate (84/16) core/shell=50/50

K-23 Shell: 2-acetoacetoxyethyl methacrylate (100) core/shell=90/10

In the present invention, the polymer latex is preferably incorporated into at least one of the silver halide emulsion layer and other hydrophilic colloid layers, and the addition amount thereof is from 5 to 400%, more preferably from 10 to 200%, based on the weight of the gelatin in hydrophilic colloid layers.

The silver halide photographic material of the present invention may further contain a water-soluble dye and a solid dispersion dye according to use purposes. For example, for high precision use where tone reproducibility is important, it is preferred to include a water-soluble dye in such an amount as to provide optical density at 360 nm of 0.2 or more, in particular, 0.4 or more.

The term "Water-soluble" used herein means that the solubility to water is 0.1% or more. Specific examples of water-soluble dyes are shown below.

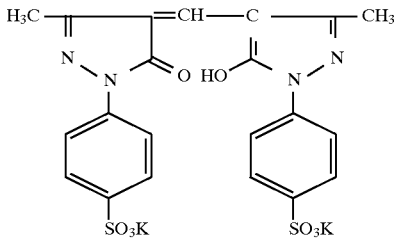

D-1

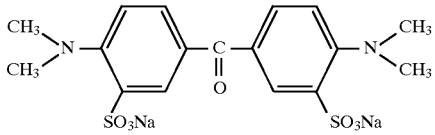

D-2

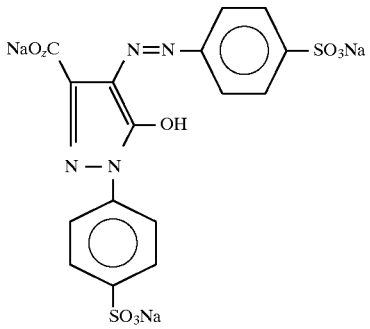

D-3

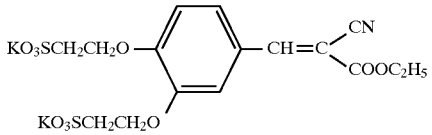

D-4

In addition to the above, the water-soluble dyes represented by formulae (3a), (3b), (3c) and (3d) in JP-A-5-249624 can also be used, and specifically Dyes 3-1 to 3-33 are preferably used.

These dyes are preferably used in an amount to give an optical density at 360 nm of 0.2 or more, preferably 0.4 or more. The upper limit thereof is the amount to provide optical density at 360 nm of 1.5 or less, preferably 1.0 or less. If the addition amount is expressed by weight, as it varies according to the molar absorption coefficient, they are generally added in an amount of from $10^{-5}$ to 1 g/m$^2$. These dyes can be added to the constitutional layers of the present invention by dissolving in an appropriate solvent (such as water, alcohol (e.g., methanol, ethanol), acetone, etc., and mixed solvents of them), but they are preferably added to the emulsion layer or a layer from which the dye can diffuse to the emulsion layer (e.g., a protective layer).

Further, for uses where tone reproducibility is variable and letter image quality is important, it is preferred to include a water-soluble dye in such an amount as to provide optical density at 360 nm of 0.15 or less and to use a solid dispersion dye in combination to secure the safety of safelight.

The necessity of using a conventional infectious developing solution or the developing solution having high pH of nearly 13 as disclosed in U.S. Pat. No. 2,419,975 to obtain superhigh contrast photographic characteristics having safety of safelight such that the material can be handled in a daylight room is eliminated by using the silver halide photographic material of the present invention with the above-described hydrazine derivative and the nucleation accelerator. Accordingly, the use of a stable developing solution having a lower pH is sufficient therefor. The silver halide photographic material of the present invention can provide sufficiently superhigh contrast images using the above-described hydrazine derivative and the nucleation accelerator by developing with a developing solution containing sulfite ion, as a preservative, in an amount of 0.15 mol/liter or more and having a pH of 9.5 to 11.0.

Development and fixation in the present invention are not particularly limited, but it is preferred to use dihydroxybenzene compounds or reductones as a developing agent of a developing solution.

Of these, preferred developing solution comprises the following compositions when a dihydroxybenzene developing agent is used:

(1) 0.2 to 0.75 mol/liter of dihydroxybenzene developing agent, (2) 0.001 to 0.06 mol/liter of a 1-phenyl-3-pyrazolidone or p-aminophenol auxiliary developing agent, (3) 0.15 to 1.2 mol/liter of free sulfite ion, and (4) compound represented by formula (12).

Further, in the above described developing solution, the concentration ratio of the compound represented by formula (12) to the dihydroxybenzene developing agent is from 0.03 to 0.12, and has a pH value of from 9.0 to 11.0, preferably from 9.5 to 10.7.

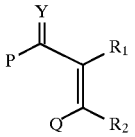

(12)

wherein $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; P and Q each represents a hydroxyl group, a carboxyl group, an alkoxyl group, a hydroxyalkyl group, a carboxyalkyl group, a sulfo group, a sulfoalkyl group, an amino group, an aminoalkyl group, an alkyl group or an aryl group, or P and Q represent an atomic group necessary for forming a 5- to 8-membered ring by bonding with each other together with the two vinyl carbon atoms on which $R_1$ and $R_2$ substitutes, respectively, and the carbon atom on which Y substitutes; Y represents =O or =N—$R_3$; and $R_3$ represents a hydrogen atom, a hydroxyl group, an alkyl group, an acyl group, a hydroxyalkyl group, a sulfoalkyl group, or a carboxyalkyl group.

Detailed explanation of formula (12) and specific examples of the compounds represented by formula (12) are disclosed in JP-A-7-168324.

The preferred compound represented by formula (12) is an ascorbic acid or an erythorbic acid (stereoisomer). The addition amount of the compound represented by formula (12) is generally such that the concentration ratio of the compound represented by formula (12) to the hydroquinone developing agent(s) (the value obtained by dividing the concentration of the compound(s) represented by formula (12) by the concentration of dihydroxybenzene developing agent(s)) is from 0.03 to 0.12, preferably from 0.03 to 0.10, and particularly preferably from 0.05 to 0.09.

Examples of the dihydroxybenzene developing agent for use in the present invention include hydroquinone, chlorohydroquinone, bromohydroquinone, isopropylhydroquinone, methylhydroquinone, 2,3-dibromohydroquinone and 2,5-dimethylhydroquinone. Of these, hydroquinone is particularly preferred. The concentration of the hydroquinone compound in a developing solution is from 0.2 to 0.75 mol/liter, preferably from 0.2 to 0.5 mol/liter, and particularly preferably from 0.2 to 0.4 mol/liter.

Examples of the 1-phenyl-3-pyrazolidone compound developing agent for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone. Of these, preferred are 1-phenyl-3-pyrazolidone and 1-phenyl-4-methyl-4-hydroxymethyl-3-pyrazolidone.

Examples of the p-aminophenol developing agent for use in the present invention include N-methyl-p-aminophenol, p-aminophenol, N-(β-hydroxyethyl)-p-aminophenol and N-(4-hydroxyphenyl)glycine. Of these, N-methyl-p-aminophenol is preferred.

When the dihydroxybenzene compound is used in combination with the 1-phenyl-3-pyrazolidone compound or the p-aminophenol compound, the amount used of the former is preferably from 0.05 mol/liter to 0.5 mol/liter and the latter is preferably 0.06 mol/liter or less.

When the reductone compound is used as a developing agent, the compound represented by formula (12) is preferably used as the reductone, and an ascorbic acid or an erythorbic acid (stereoisomer) is particularly preferred. In this case, the same auxiliary developing agent as used in the case of the dihydroxybenzene developing agent can be used, and p-aminophenol compound auxiliary developing agents and/or 1-phenyl-3-pyrazolidone compound auxiliary developing agents are preferably used. When the compound represented by formula (12) is used as a developing agent, the addition amount is generally from $5\times10^{-3}$ mol to 1 mol, particularly preferably from $10^{-2}$ mol to 0.5 mol, per liter of the developing solution.

A preservative for use in the preferred developing solution of the present invention is a free sulfite ion, which is added to the developing solution in the form of sodium sulfite, lithium sulfite, ammonium sulfite or sodium bisulfite. The concentration of the free sulfite ion is from 0.15 to 1.2 mol/liter, preferably from 0.3 to 1.0 mol/liter, and particularly preferably from 0.3 to 0.8 mol/liter.

The pH of the developing solution for use in the development processing of the present invention is generally from 9.0 to 11.0, and preferably from 9.5 to 10.7. Examples of the alkali agents used for adjusting the pH include pH adjustors such as sodium hydroxide, sodium carbonate, sodium tertiary phosphate, potassium hydroxide and potassium carbonate and boric acid.

Dialdehyde hardening agents or bisulfite addition products thereof may be used in the developing solution according to the present invention. Specific examples thereof include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, α,α-diethylsuccindialdehyde, butylmaleindialdehyde, or bisulfite addition products of these compounds. Of these, glutaraldehyde or bisulfite addition products thereof is generally used. The dialdehyde compound is used in an amount such that the sensitivity of the photographic layer to be processed is not restrained and the drying time is not so prolonged. Specifically, the compound is used in an amount of from 1 g to 50 g, preferably from 3 g to 10 g, per liter of the developing solution.

An antifoggant such as indazole, benzimidazole or benzotriazole antifoggants are used in the developing solution according to the present invention. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, and 5-amino-1,3,4-thiadiazoie-2-thiol. The addition amount of these antifoggants is generally from 0.01 to 10 mmol, more preferably from 0.1 to 2 mmol, per liter of the developing solution. Halide compounds such as potassium bromide and sodium bromide can be used in addition to the above organic antifoggants.

Further, various kinds of organic and inorganic chelating agents can be used in combination in the developing solution of the present invention. Examples of the inorganic chelating agents include sodium tetrapolyphosphate and sodium hexametaphosphate.

Examples of the organic chelating agent include organic carboxylic acid, aminopolycarboxylic acid, organic phosphonic acid, aminophosphonic acid and organic phosphonocarboxylic acid.

Examples of the organic carboxylic acid include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid and tartaric acid, but the organic carboxylic acid is not limited thereto.

Examples of the aminopolycarboxylic acid include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and the compounds disclosed in JP-A-52-25632, JP-A-55-67747, JP-A-57-102624, and JP-B-53-40900.

Examples of the organic phosphonic acid include the hydroxyalkylidene-diphosphonic acid disclosed in U.S. Pat. Nos. 3,214,454, 3,794,591 and German Patent Publication No. 2,227,639, and the compounds disclosed in *Research Disclosure*, Vol. 181, Item 18170 (May, 1979).

Examples of the aminophosphonic acid include amninotris(methylenephosphonic acid), ethylenediaminotetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acid include the compounds disclosed in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol. per liter of the developing solution.

The developing solution for use in the present invention can contain various additives, if required, in addition to the above described components, for example, a buffer (e.g., carbonate, alkanolamine), an alkali agent (e.g., hydroxide, carbonate), an auxiliary solvent (e.g., polyethylene glycols, esters thereof), a pH adjustor (e.g., organic acid such as acetic acid), a development accelerator (e.g., various pyridinium compounds and other cationic compounds, cationic dyes such as phenosafranine, and neutral salts such as thallium nitrate and potassium nitrate, as disclosed in U.S. Pat. No. 2,648,604, JP-B-44-9503 and U.S. Pat. No. 3,171,247; polyethylene glycol and derivatives thereof, nonionic compounds such as polythioethers, as disclosed in JP-B-44-9304, U.S. Pat. Nos. 2,533,990, 2,531,832, 2,950,970 and 2,577,127; organic solvents as disclosed in JP-B-44-9509 and Belgian Patent 682,862; and thioether based compounds as disclosed in U.S. Pat. No. 3,201,242, thioether based compounds being particularly preferred of them), and a surfactant.

The development processing temperature and the development processing time are mutually related, and determined in relationship with the total processing time. In general, the processing temperature is from about 20° C. to about 50° C. and the processing time is from 10 seconds to 2 minutes.

If 1 $m^2$ of a silver halide black-and-white photographic material is processed, the replenishment rate of the developing solution is generally 400 ml or less and preferably 200 ml or less.

The fixing solution for use in the fixing step in the present invention is an aqueous solution containing sodium thiosulfate, ammonium thiosulfate and, if necessary, tartaric acid, citric acid, gluconic acid, boric acid, iminodiacetic acid, 5-sulfosalicylic acid, glucoheptanic acid, Tiron, ethylenediaminetetraacetic acid, diethylenetriaminepentaacetic acid, nitrilotriacetic acid, and the salts of these compounds. From the viewpoint of environmental protection, boric acid is preferably not contained.

Sodium thiosulfate and ammonium thiosulfate are used as a fixing agent of the fixing solution in the present invention, and ammonium thiosulfate is preferred from the point of fixing speed, but sodium thiosulfate may be used from the environmental protection in recent years. The amount used of these known fixing agents can be varied arbitrarily, and is generally from about 0.1 to about 2 mol/liter, particularly preferably from 0.2 to 1.5 mol/liter.

The fixing solution can contain, if desired, a hardening agent (e.g., a water-soluble aluminum compound), a preservative (e.g., sulfite, bisulfite), a pH buffer (e.g., acetic acid), a pH adjustor (e.g., ammonia, sulfuric acid), a chelating agent, a surfactant, a wetting agent and a fixing accelerator.

Specific examples of the surfactant include an anionic surfactant, e.g., a sulfated product and a sulfonated product, a polyethylene surfactant, and the amphoteric surfactants disclosed in JP-A-57-6740. Further, known defoaming agents can also be used. Specific examples of the wetting agent include alkanolamine and alkylene glycol. Specific examples of the fixing accelerator include the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, and the mesoionic compounds disclosed in JP-A-4-229860, and the compounds disclosed in JP-A-2-44355 may also be used.

The pH of the fixing solution is preferably from 4.0 to 6.5, particularly preferably from 4.5 to 6.0.

Further, the compounds disclosed in JP-A-64-4739 can be used as a dissolution accelerator of a dye.

Examples of the hardening agent optionally added to the fixing solution of the present invention includes water-soluble aluminum salts and chromium salts. Preferred of them are water-soluble aluminum salts, e.g., aluminum chloride, aluminum sulfate, and potassium alum. They are preferably used in an amount of from 0.01 to 0.2 mol/liter, more preferably from 0.03 to 0.08 mol/liter.

The temperature of the fixing solution is from about 20° C. to about 50° C., preferably from 25° C. to 45° C., and the fixing time is from 5 seconds to 1 minute, preferably from 7 seconds to 50 seconds.

The replenishment rate of the fixing solution is 600 ml/m$^2$ or less, particularly preferably 300 ml/m$^2$ or less, per the processing amount of the material.

A photographic material after developed and fixed is subjected to washing or stabilizing processing. Washing or stabilizing processing can be carried out with a replenishing rate of 3 liters or less per m$^2$ of the silver halide photographic material (including zero, i.e., washing in a reservoir). That is, water saving processing can be carried out. In addition, piping for installation of an automatic processor is not required. When washing is carried out with a reduced amount of water, it is preferred to use a purifying tank equipped with a squeeze roller, as disclosed in JP-A-63-18350 and JP-A-62-287252. When the washing is carried out with a small amount of water, the addition of various kinds of oxidizing agents and the provision of filters for filtration may be combined therewith to reduce environmental pollution which becomes a problem in such a case. Further, all or a part of overflow liquid generated from the washing tank or the stabilizing tank by the replenishment of the water applied with an antimold means to the washing tank or the stabilizing tank in proportion to the processing amount by the method according to the present invention can be utilized in the preceding processing step as a processing solution having a fixing ability as disclosed in JP-A-60-235133. Moreover, a water-soluble surfactant or a defoaming agent may be included in washing or stabilizing tank to prevent generation of irregular foaming which is liable to generate when washing is conducted with a small amount of water and/or to prevent components of the processing agents adhered to a squeeze roller from transferring to the processed film. In addition, dye adsorbents disclosed in JP-A-63-163456 may be included in a washing tank to inhibit contamination due to dyes dissolved from photographic materials.

Also, the photographic material of the present invention may be subjected to stabilizing processing after the washing processing. In such a case, bath containing compounds disclosed in JP-A-2-201357, JP-A-2-132435, JP-A-1-102553 and JP-A-46-44446 may be used as a final bath. This stabilizing bath may contain, if required, an ammonium compound, a metal compound such as Bi and Al, a brightening agent, various kinds of chelating agents, a film pH adjustor, a hardening agent, a sterilizer, an antimold agent, an alkanolamine and a surfactant. Tap water, deionized water, and water sterilized by a halogen, ultraviolet sterilizing lamp or various oxidizing agents (e.g., ozone, hydrogen peroxide, chlorate) are preferably used as water for the stabilizing tank.

The processing solutions for use in the pre sent invention are preferably preserved in the packaging materials of low oxygen permeation as disclosed in JP-A-61-73147.

On the other hand, in the case when the replenishment rate is reduced, it is preferred to prevent evaporation and air oxidation of the solution by minimizing the area of the solution contacting with the air in the processing tank. A roller transporting type automatic processor is disclosed in U.S. Pat. Nos. 3,025,779 and 3,545,971. A roller transporting type processor comprising four steps of development, fixation, washing and drying is preferably used.

The above processing solutions may be made into solid processing agents.

The solid processing agents which are preferably used in the present invention are powder, tablets, granules, lumps or paste, and preferred forms are the forms disclosed in JP-A-61-259921 or tablets. The ordinary methods for producing tablets disclosed in JP-A-51-61837, JP-A-54-155038, JP-A-52-88025 and British Patent 1,213,808 can be applied to the present invention, and granules can be produced by the ordinary methods disclosed, for example, in JP-A-2-109042, JP-A-2-109043, JP-A-3-39735 and JP-A-3-39739. Further, powder processing agents can be produced according to the ordinary methods disclosed in JP-A-54-133332, British Patents 725,892, 729,862 and German Patent 3,733,861.

The bulk density of the solid processing agents of the present invention is preferably from 0.5 to 6.0 g/cm$^3$, particularly preferably from 1.0 to 5.0 g/cm$^3$ from the viewpoint of solubility and the effect of the present invention.

There are no particular limitations with respect to various additives for use in the photographic material of the present invention and, for example, those described at the following portion of the following literature can be preferably used.

| Item | Places |
|---|---|
| 1) Spectral sensitizing dye | Line 13, left lower column, page 8 to line 4, right lower column, page 8 of JP-A-2-12236; line 3, right lower column, page 16 to line 20, left lower column, page 17 of JP-A-2-103536; JP-A-1-112235; JP-A-2-124560; JP-A-3-7928; JP-A-5-11389 and JP-A-4-330434 |
| 2) Surfactant and antistatic agent | Line 7, right upper column, page 9 to line 7, right lower column, page 9 of JP-A-2-12236; and line 13, left lower column, page 2 to line 18, right lower column, page 4 of JP-A-2-18542 |
| 3) Antifoggant and stabilizer | Line 19, right lower column, page 17 to line 4, right upper column, page 18 of JP-A-2-103536; lines 1 |

-continued

| Item | Places |
|---|---|
| | to 5, right lower column, page 18 of JP-A-2-103536; and the thiosulfinic acid compounds in JP-A-1-237538 |
| 4) Compound having acid radical | Line 5, right lower column, page 8 to line 1, left upper column, page 19 of JP-A-2-103536; and line 13, right lower column, page 8 to line 8, left upper column, page 11 of JP-A-2-55349 |
| 5) Matting agent and sliding agent | Line 15, left upper column, page 19 to line 15, right upper column, page 19 of JP-A-2-103536 |
| 6) Hardening agent | Lines 5 to 17, right upper column, page 18 of JP-A-2-103536 |
| 7) Dye | Lines 1 to 18, right lower column, page 17 of JP-A-2-103536; line 1, right upper column, page 4 to line 5, right upper column, page 6 of JP-A-2-39042; JP-A-2-294638; the dyes in JP-A-63-296039; the solid dyes in WO 88/04794, EP 456148, JP-A-5-11382, and JP-A-7-301878 |
| 8) Binder | Lines 1 to 20, right lower column, page 3 of JP-A-2-18542 |
| 9) Black spot inhibitor | The compounds in U.S. Pat. No. 4,956,257 and JP-A-1-118832 |
| 10) Redox compound | The compounds represented by formula (I) (particularly Compounds 1 to 50) in JP-A-2-301743; Formulae (R-1), (R-2) and (R-3), Compounds 1 to 75 on pages 3 to 20 in JP-A-3-174143; and the compounds in JP-A-5-257239 and JP-A-4-278939 |
| 11) Monomethine compound | The compounds represented by formula (II) (particularly Compounds II-1 to II-26) in JP-A-2-287532 |
| 12) Dihydroxybenzenes | From left upper column, page 11 to left lower column, page 12 of JP-A-3-39948; and the compounds in EP-A-452772 |
| 13) Polymer latex | Lines 12 to 20, left lower column, page 18 of JP-A-2-103536; the polymer latexes having an active methylene group in JP-B-46-22507, JP-A-50-73625, U.S. Pat. Nos. 3,488,708, 3,939,130, 3,929,482 and JP-A-7-152112 |
| 14) Organic desensitizer | The compounds in JP-B-3-76450, JP-A-63-64039 and JP-A-7-301878 |
| 15) Compound having an amino group, an ammonium group and a nitrogen-containing heterocyclic ring | Line 5, page 8 to line 5, page 40 of JP-A-63-133145 |

The present invention will be described in more detail below with reference to the following Examples, but the present invention should not be construed as being limited thereto.

EXAMPLE 1

Preparation of Emulsion

Emulsion A:

An aqueous solution of silver nitrate and an aqueous solution of sodium chloride containing $4\times10^{-5}$ mol/mol-Ag of $K_2Ru(NO)Cl_5$ were simultaneously added to a 1.5% aqueous solution of gelatin (pH: 2.0) being maintained at 38° C. and containing sodium chloride and $3\times10^{-5}$ mol/mol-Ag of sodium benzenethiosulfonate by a double jet method at a potential of 95 mV over 3 minutes and 30 seconds, so that half of the silver amount of final grains were added, to thereby prepare core grains having a grain size of 0.12 μm. Then, an aqueous solution of silver nitrate and an aqueous solution of sodium chloride containing $4\times10^{-5}$ mol/mol-Ag of $K_2Ru(NO)Cl_5$ were added over 7 minutes in the same manner as above and silver chloride cubic grains having the average grain size of 0.15 μm were prepared (variation coefficient: 12%).

The mixture was then washed according to an ordinary flocculation method in the art, soluble salt was removed, and gelatin was added. Chemical ripening was not conducted, and Compound-F and phenoxyethanol as an antiseptic each in an amount of 50 mg/mol-Ag, $10^{-3}$ mol/mol-Ag of 4-hydroxy-6-methyl-1,3,3a,7-tetrazaindene as a stabilizer were added. (Finally obtained grains had pH 5.5, pAg 7.5, Ru $4\times10^{-5}$ mol/mol-Ag.)

Emulsion B:

Grain formation was carried out in the same manner as the preparation of Emulsion A, then washed, gelatin was added and pH and pAg were adjusted to 5.5 and 7.5, respectively. Further, $1\times10^{-5}$ mol/mol-Ag of sodium thiosulfate, $1\times10^{-5}$ mol/mol-Ag of the selenium sensitizer (SE-3) according to the present invention, and $4\times10^{-5}$ mol/mol-Ag of chloroauric acid were added, and the emulsion was heated at 65° C. for 60 minutes and chemical sensitization was carried out, then a stabilizer and an antiseptic were added in the same manner as in Emulsion A.

Emulsion C:

Emulsion C was the same emulsion as Emulsion B except that $KRu(NO)_2Cl_4$ instead of $K_2Ru(NO)Cl_5$ was doped in the grain formation.

Preparation of Coating Solution for Emulsion Layer and Coating Thereof:

The following compounds were added to each of Emulsions A to C to prepare coating solutions, and the thus obtained coating solutions were, respectively, coated on a support having an undercoat layer as described below to provide a silver halide emulsion layer having a gelatin coating amount of 0.9 g/m$^2$ and a silver coating amount of 2.75 g/m$^2$.

| | |
|---|---|
| Sodium N-oleyl-N-methyltaurine | 19 mg/m$^2$ |
| Hydrazine Derivative (I-23) | 15 mg/m$^2$ |
| Nucleation Accelerator-$B_1$ | 20 mg/m$^2$ |
| Sodium 3-(5-mercaptotetrazole)benzene-sulfonate | 11 mg/m$^2$ |
| Compound A | 13 mg/m$^2$ |
| Ascorbic Acid | 1 mg/m$^2$ |
| Compound B | 15 mg/m$^2$ |
| Compound C | 70 mg/m$^2$ |
| Acetic Acid | an amount to provide film pH of 5.2 to 6.0 |
| Compound D | 950 mg/m$^2$ |
| Liboran-1400 (manufactured by Lion Yushi Co., Ltd.) | 47 mg/m$^2$ |
| Compound E (hardening agent) | an amount to provide swelling factor in water of 80% |

The following lower and upper emulsion protective layers were coated as upper layers on the above emulsion layer.

Preparation of Coating Solution for Lower Emulsion Protective Layer and Coating Thereof The following compounds were added to an aqueous solution of gelatin, and the thus obtained coating solution was coated to provide a lower emulsion protective layer having a gelatin coating amount of 0.8 g/m$^2$.

| | |
|---|---|
| Gelatin ($Ca^{++}$ content: 2,700 ppm) | 0.8 g/m$^2$ |
| Compound F | 1 mg/m$^2$ |
| 1,5-Dihydroxy-2-benzaldoxime | 14 mg/m$^2$ |
| $C_2H_5SO_2SNa$ | 3 mg/m$^2$ |
| Compound C | 3 mg/m$^2$ |
| Sodium p-Dodecylbenzenesulfonate | 7 mg/m$^2$ |
| Compound G | 20 mg/m$^2$ |

Preparation of Coating Solution for Upper Emulsion Protective Layer and Coating Thereof The following compounds were added to an aqueous solution of gelatin, and the thus obtained coating solution was coated to provide an upper emulsion protective layer having a gelatin coating amount of 0.45 g/m$^2$.

| | |
|---|---|
| Gelatin ($Ca^{++}$content: 2,700 ppm) | 0.45 g/m$^2$ |
| Amorphous Silica Matting Agent (average particle size: 4.4 $\mu$m) | 40 mg/m$^2$ |
| Amorphous Silica Matting Agent (average particle size: 3.6 $\mu$m) | 10 mg/m$^2$ |
| Compound F | 1 mg/m$^2$ |
| Compound C | 8 mg/m$^2$ |
| Solid Dispersion Dye $G_1$ | 68 mg/m$^2$ |
| Flowing Paraffin | 21 mg/m$^2$ |
| Potassium N-Perfluorooctanesulfonyl-N-propylglycine | 5 mg/m$^2$ |
| Sodium p-Dodecylbenzenesulfonate | 29 mg/m$^2$ |

The following electrically conductive layer and backing layer were simultaneously coated on the opposite side of the support.

Preparation of Coating Solution for Electrically Conductive Layer and Coating Thereof The following compounds were added to an aqueous solution of gelatin to prepare a coating solution for the electrically conductive layer, and the coating solution was coated to have a gelatin coating amount of 0.06 g/m$^2$.

| | |
|---|---|
| $SnO_2$/Sb (9/1 in weight ratio, average particle size: 0.25 $\mu$m) | 186 mg/m$^2$ |
| Gelatin ($Ca^{++}$ content: 2,700 ppm) | 0.06 g/m$^2$ |
| Sodium p-Dodecylbenzenesulfonate | 13 mg/m$^2$ |
| Sodium Dihexyl-α-sulfosuccinato | 12 mg/m$^2$ |
| Compound C | 12 mg/m$^2$ |
| Compound F | 1 mg/m$^2$ |

Preparation of Coating Solution for Backing Layer and Coating Thereof

The following compounds were added to an aqueous solution of gelatin to prepare a coating solution for the backing layer, and the coating solution was coated to have a gelatin coating amount of 1.94 g/m$^2$.

| | |
|---|---|
| Gelatin ($Ca^{++}$ content: 30 ppm) | 1.94 g/m$^2$ |
| Polymethyl Methacrylate Fine Particles (average particle size: 4.7 $\mu$m) | 7 mg/m$^2$ |
| Compound H | 233 mg/m$^2$ |
| Compound I | 21 mg/m$^2$ |
| Compound G | 146 mg/m$^2$ |
| Compound F | 3 mg/m$^2$ |
| Sodium p-Dodecylbenzenesulfonate | 68 mg/m$^2$ |
| Sodium Dihexyl-α-sulfosuccinato | 21 mg/m$^2$ |
| $C_8F_{17}SO_3Li$ | 4 mg/m$^2$ |
| Potassium N-Perfluorooctanesulfonyl-N-propylglycine | 6 mg/m$^2$ |
| Sodium Sulfate | 177 mg/m$^2$ |
| Compound E (hardening agent) | an amount to provide swelling factor in water of 90% |

Support and Undercoat Layer

On both sides of a biaxially stretched polyethylene terephthalate support having a thickness of 100 $\mu$m, first and second undercoat layers having the following compositions were coated.

First Undercoat Layer

| | |
|---|---|
| Core/Shell Type Vinylidene Chloride Copolymer (1) | 15 g |
| 2,4-Dichloro-6-hydroxy-s-triazine | 0.25 g |
| Polystyrene Fine Particles (average particle size: 3 $\mu$m) | 0.05 g |
| Compound M | 0.20 g |
| Colloidal Silica (Snow tex ZL (particle size: 70 to 100 $\mu$m) (produced by Nissan Chemical Industries, Ltd.) | 0.12 g |
| Water to make | 100 g |

Further, the pH of the thus obtained coating solution was adjusted to be 6 by adding thereto 10 wt % of KOH, and then was coated on the support at a drying temperature of 180° C. for 2 minutes so that the dried film thickness reached 0.9 $\mu$m.

Second Undercoat Layer

| | |
|---|---|
| Gelatin | 1 g |
| Methyl Cellulose | 0.05 g |
| Compound J | 0.02 g |
| $C_{12}H_{25}O(CH_2CH_2O)_{10}H$ | 0.03 g |
| Compound F | $3.5 \times 10^{-3}$ g |
| Acetic Acid | 0.2 g |
| Water to make | 100 g |

The coating solution was coated on the support at a drying temperature of 170° C. for 2 minutes so that the dried film thickness reached 0.1 $\mu$m.

Compound A

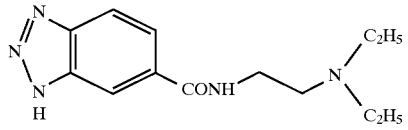

Compound B

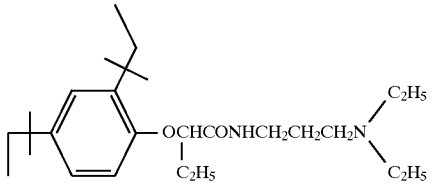

Compound C

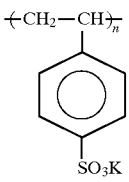

-continued

Compound D (core/shell type latex)

Core part

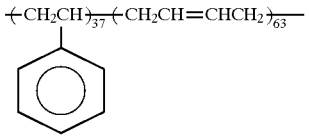

Shell part

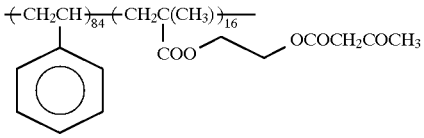

core/shell = 50/50

Compound E

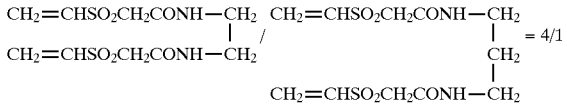

Compound F

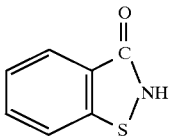

Compound G

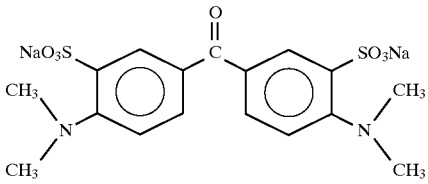

Solid Dispersion Dye $G_1$

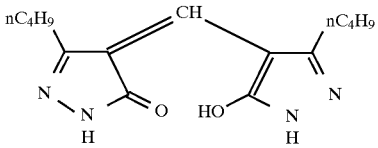

Compound H

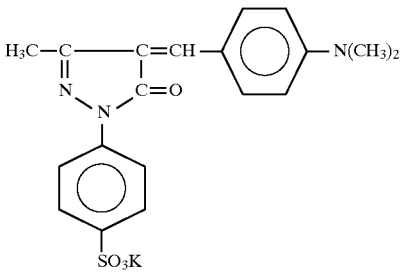

-continued

Compound I

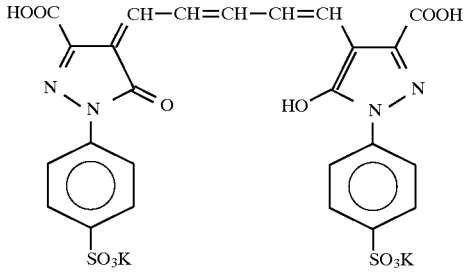

Compound J

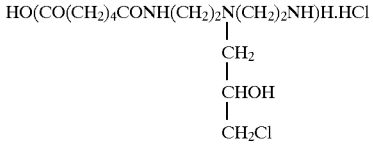

Nucleation Accelerator $B_1$

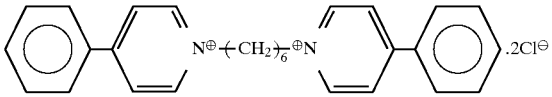

Core/Shell Type Vinylidene Chloride Copolymer (1)

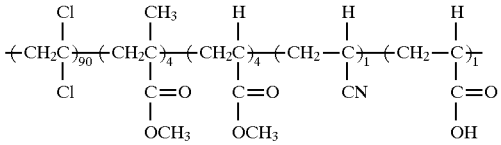

| VDC | MMA | MA | AN | AA |
|---|---|---|---|---|

Core: VDC/MMA/MA (80% by weight)
Shell: VDC/AN/AA (20% by weight)
Average particle size: 70 nm Compound M

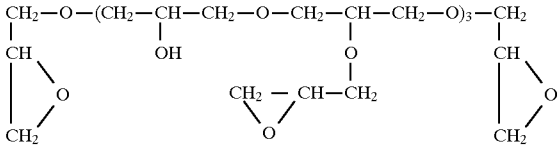

A coating method and drying conditions were as follows.

Coating Method

The emulsion layer, the lower emulsion protective layer and the upper emulsion protective layer were multilayer-coated simultaneously on the above prepared support having the undercoat layer in this order from the support. The coating was conducted with adding a hardening solution by a slide hopper system while maintaining the temperature at 35° C. After passing a cold air setting zone (5° C.), the electrically conductive layer and the backing layer were multilayer-coated simultaneously on the opposite side of the emulsion layer side in this order from the support also with adding a hardening solution by a slide hopper system, then passed the cold air setting zone (5° C.). At the point when the material passed each setting zone, each coating solution showed sufficient setting capability. Subsequently, both sides of the material were dried simultaneously in a drying zone under the following conditions. After coating of the back face until winding up, the material was transported so as not to touch anything, e.g., rollers and others. The coating rate at this time was 120 m/min.

Drying Condition

After passing the cold air setting zone, the material was dried with a dry air of 30° C. until the weight ratio of water/gelatin became 800%, then dried with a 35° C.-30% RH dry air until 800% of the weight ratio became 200%, the material was continued to be exposed to the air, and 30 seconds after the time when the surface of the material reached 34° C. (regarded it as the completion of drying), the material was further dried with a 48° C.-2% RH air for 1 minute. It took 50 seconds for the water/gelatin weight ratio to reach 800% from the beginning of drying, 35 seconds from 800% to 200%, and 5 seconds from 200% to the completion of drying.

This material was wound up at 23° C.-40% RH, then cut in the same atmosphere and, after being humidity conditioned at 40° C.-10% RH for 8 hours, sealed in a barrier bag which was humidity-conditioned for 6 hours, with a cardboard humidity-conditioned at 23° C. 40% for 2 hours, and samples shown in Table 1 were prepared.

The humidity in the barrier bag was 40% RH.

Evaluating Method

Photographic Characteristics

Each of the thus-obtained samples was subjected to exposure through an optical wedge with P-627FM printer manufactured by Dai Nippon Screen Mfg. Co., Ltd., then underwent development processing at 38° C. for 20 seconds using automatic processor FG-680AG (manufactured by Fuji Photo Film Co., Ltd.) and developing solution 1 described below, followed by fixing, washing and drying. A fixing solution used was fixing solution 1 having the composition shown below. Samples were evaluated for the following items.

$\gamma$=(1.5−0.1)/[log(exposure amount giving a density of 1.5)−log(exposure amount giving a density of 0.1)].

Letter Image Quality

For evaluation of letter image quality, an original having the constitution of: a transparent film base; a film on which a positive image of line work is formed (line original); a transparent film base; and a film on which a halftone image is formed (halftone original) laminated in this order, as disclosed in FIG. 1 of JP-B-2-28856 was prepared. This original was contacted with the emulsion surface of each sample, imagewise exposed using P-627FM printer and development processed (the same processing as above).

The exposure time of each sample was determined so as to form a dot image having a dot percent of 50% on the respective sample with the halftone original having a dot percent of 50%.

Here, letter image quality grade 5 means such quality that reproduces the letter of 30 $\mu$m width on the photographic material for dot to dot work when appropriately exposed to give a dot area of 50% using an original shown in FIG. 1 as described above, which is very excellent letter image quality. On the other hand, letter image quality grade 1 means the image quality which can only reproduce the letter of 150 $\mu$m width or more with the same appropriate exposure, which is not good letter image quality. Grades 4, 3 and 2 are provided between grades 5 and 1 by functional evaluation. Grade 3 or more are acceptable in practical use.

Practical Dmax

Dmax means the maximum blacking density when exposure is conducted to give 50% dot area on the film sample with using the 50% halftone original described in the evaluation of "letter image quality".

Storability Δfog

The sample was allowed to stand at 60° C., 30% RH condition for 3 days, then subjected to the same processing described in "photographic characteristics" and fog change from immediately after coating was determined. (fog after stored (60° C., 30% RH, 3 day)—fog immediately after coating) The larger the value, the worse is the storability.

Developing Solution 1

| | |
|---|---|
| Potassium Hydroxide | 40.0 g |
| Diethylenetriaminepentaacetic Acid | 2.0 g |
| Potassium Carbonate | 60.0 g |
| Sodium Metabisulfite | 70.0 g |
| Potassium Bromide | 7.0 g |
| Hydroquinone | 40.0 g |
| 5-Methylbenzotriazole | 0.35 g |
| 4-Hydroxymethyl-4-methyl-1-phenyl-3-pyrazolidone | 1.50 g |
| Sodium 2-Mercaptobenzimidazole-5-sulfonate | 0.30 g |
| Sodium 3-(5-Mercaptotetrazol-1-yl)-benzenesulfonate | 0.10 g |
| Sodium Erythorbate | 6.0 g |
| Diethylene Glycol | 5.0 g |
| Water to make | 1 liter |
| pH was adjusted to 10.65 with potassium hydroxide | |

Fixing Solution 1

| | |
|---|---|
| Ammonium Thiosulfate | 119.7 g |
| Disodium Ethylenediaminetetraacetate Dihydrate | 0.03 g |
| Sodium Thiosulfate Pentahydrate | 10.9 g |
| Sodium Sulfite | 25.0 g |
| NaOH (pure part) | 12.4 g |
| Glacial Acetic Acid | 29.1 g |
| Tartaric Acid | 2.92 g |
| Sodium Gluconate | 1.74 g |
| Aluminum Sulfate | 8.4 g |
| pH (adjusted with sulfuric acid or sodium hydroxide) | 4.8 |
| Water to make | 1 liter |

TABLE 1

| Sample No. | Emulsion No. | Hydrazine Derivative | $\gamma$ | Letter Image | Practical Dmax | Δfog | Remarks |
|---|---|---|---|---|---|---|---|
| 1 | A | Used | 8 | 2 | 2.5 | 0.02 | Comparison |
| 2 | B | Used | 30 | 5 | 5.5 | 0.02 | Invention |
| 3 | B | Not used | 15 | 3 | 4.5 | 0.02 | Invention |
| 4 | C | Used | 20 | 4 | 4.8 | 0.15 | Comparison |
| 5 | C | Not used | 10 | 2 | 3.8 | 0.12 | Comparison |

As is apparent from the results in Table 1, samples of the present invention (Sample Nos. 2 and 3) show high contrast photographic characteristics showing $\gamma$ values of 15 or more, and realize the compatibility of letter image quality with high Dmax. Further, storability is good and therefore these high qualities can be maintained for a long period of time.

The heavy metal of Emulsion B was replaced, respectively, with $(NH_4)_2Rh(H_2O)Cl_5$, $KIr(NO)Cl_5$ and $K_2Ru(H_2O)Cl_5$ and three kinds emulsions were prepared. The same evaluations as in Table 1 were carried out with respect to these three emulsion. It was confirmed that these emulsions showed high contract, high Dmax, high image quality and good storability.

EXAMPLE 2

The content of the heavy metal of each emulsions used in Example 1 was changed to $5\times10^{-6}$ mol/mol-Ag, and same evaluations were conducted. The samples according to the present invention showed high contract, high Dmax, high image quality and good storability.

EXAMPLE 3

Sample Nos. 1 to 5 in Example 1 were processed with developing solution 2 and fixing solution 2 and same evaluations in Example 1 were conducted. Samples of the present invention (Sample Nos. 2 and 3) showed high contract, high Dmax, high image quality and good storability.

Developing Solution 2

Water was added to the following solid developer to make 10 liters of working solution.

Solid developer was filled in a high density polyethylene container (average thickness: 500 μm, partially from 200 to 1,000 μm) as solid developing components in an amount corresponding to that for 10-liters working solution. The components were mixed each other before filled in a container.

The composition of 10 liters of the working solution of developing solution and the forms of raw materials are shown in Table 2.

TABLE 2

| No. of Developing Solution | Form of Raw Material | |
|---|---|---|
| Sodium hydroxide (99.5%) (numeral in parentheses is fineness) | Bead | 115 g |
| Potassium Sulfite | Raw Material | 718 g |
| Sodium Sulfite | Raw Material | 350 g |
| Diethylenetriaminepentaacetiic acid | Briquette in admixture | 20 g |
| 5-Methylbenzotriazole | | 3.5 g |
| Sodium 2-Mercaptoimidazole-5 sulfonate | | 3.0 g |
| Sodium 3-(5-Mercaptotetrazol-1-yl)-benzenesulfonate | | 1.0 g |
| Potassium Bromide | | 66 g |
| 4-Hydroxymethyl-4-methyl-1-phenyl-3-pyrazolidone | | 15 g |
| Sodium Erythorbate | | 60 g |
| Potassium Carbonate | Raw Material | 620 g |
| Hydroquinone | Briquette | 400 g |
| Total weight | | 2,336 g |
| Alkali wt % | | 4.9% |
| pH | | 10.6 |

With respect to the forms of raw materials, general industrial products as it is was used as the "raw material". "Beads" and pellets of alkali metal salt used were products on the market.

Raw materials in the form of "briquette" were compressed using a briquette machine, each made into a shapeless oval form of 4 to 6 mm in length and then pulverized. With respect to components of small amount, each components were blended in admixture and then made into a briquette form.

Fixing Solution 2

Water was added to the following solids and liquids to make 10 liters of working solution.

The following solid part and liquid part of the components of the fixing solution filled in a high density polyethylene container (average thickness: 500 μm, partially from 200 to 1,000 μm) was used.

Solid Part

| | |
|---|---|
| Ammonium Thiosulfate | 1,200 g |
| Sodium Thiosulfate | 150 g |
| Sodium Acetate | 400 g |
| Sodium Metabisulfite | 200 g |

Liquid Part

| | |
|---|---|
| Aluminum Sulfate (27%) | 300 g |
| Sulfuric Acid (75%) | 30 g |
| Sodium Gluconate | 20 g |
| EPTA | 0.3 g |
| Citric Acid | 40 g |

The above solid part was filled after mixing the components thereof.

EXAMPLE 4

Evaluation of practical Dmax was carried out by changing 175 lines of the halftone original used for evaluation of letter image quality in Example 1 to 700 lines of high precision halftone original. (Sample Nos. 1, 2 and 4.)

TABLE 3

| Sample No. | Emulsion No. | Hydrazine Derivative | Practical Dmin | Remarks |
|---|---|---|---|---|
| 1 | A | Used | 2.0 | Comparison |
| 2 | B | Used | 5.0 | Invention |
| 4 | C | Used | 3.9 | Comparison |

As is apparent from Table 3, the sample of the present invention showed high practical Dmax of 5.0 even when standard exposure for high precision use was under exposure as compared to that in common printing.

EXAMPLE 5

The halogen composition of Emulsion B was changed with being adjusted as shown in Table 4 by adding KBr to a halide solution to be added by a double jet method. Coating was conducted in the same manner as for Sample No. 2, and processed in the same manner as in Example 1 using the following developing solution 3 and fixing solution 1. The results of evaluation with respect to safety of safelight are shown in Table 4. The evaluation of safety of safelight was conducted by irradiating with 400 Lux using a discoloration inhibiting fluorescent lamp (FLR40SW-DL-X NU/M manufactured by Toshiba Co.) and expressed by the radiation time took until when Dmin increased by 0.02.

Developing Solution 3

| | |
|---|---|
| Potassium Hydroxide | 1.71 g |
| Diethylenetriaminepentaacetic Acid | 4 g |
| Potassium Carbonate | 27.5 g |
| Sodium Carbonate | 25.5 g |
| Sodium Erythorbate | 30 g |
| N-Methyl-p-aminophenol | 7.5 g |
| KBr | 2 g |
| 5 -Methylbenzotriazole | 0.1 g |
| 1-Phenyl-5-mercaptotetrazole | 0.02 g |
| Sodium Sulfite | 5 g |
| Glacial Acetic Acid | 9 g |
| Water to make | 1 liter |
| pH was adjusted to 9.8 | |

TABLE 4

| Sample No. | Halogen Composition | Safety of Safelight | Remarks |
|---|---|---|---|
| 2 | AgCl (Emulsion B) | 120' | Invention |
| 6 | $AgBr_1Cl_{99}$ | 60' | Invention |
| 7 | $AgBr_2Cl_{98}$ | 30' | Invention |
| 8 | $AgBr_5Cl_{95}$ | 4' | Invention |
| 9 | $AgBr_{10}Cl_{90}$ | less than 1' | Comparison |

As is apparent from Table 4, samples of the present invention can be handled in a daylight room. In particular, emulsion in which AgCl is used is excellent.

EXAMPLE 6

The same preparation and coating of emulsions as in Emulsion B (Sample No. 2) were conducted except for replacing the selenium compound with comparative Compounds 1 and 2, respectively, and/or for changing pAg and pH. Evaluation of storability was conducted using Developing Solution 2 and Fixing solution 2. The results obtained are shown in Table 5.

Selenium Compound

TABLE 5

Comparative compound 1

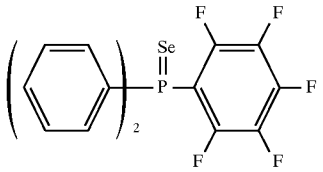

Comparative compound 2

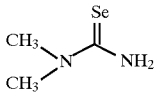

| Sample No. | Selenium Compound | Sodium Thiosulfate (mol) | pAg | pH | Δfog | Remarks |
|---|---|---|---|---|---|---|
| 2 | SE-3 | $1 \times 10^{-5}$ | 7.5 | 5.5 | 0.02 | Invention |
| 10 | Comparative Compound 1 | " | 7.5 | 5.5 | 0.21 | Comparison |
| 11 | SE-3 | " | 8.0 | 5.5 | 0.02 | Invention |
| 12 | SE-3 | " | 6.5 | 6.5 | 0.04 | Invention |
| 13 | Comparative Compound 2 | " | 6.5 | 6.5 | 0.33 | Comparison |
| 14 | — | $2 \times 10^{-5}$ | 6.5 | 6.5 | 0.14 | Comparison |

As is apparent from Table 5, samples of the present invention (Sample Nos. 2, 11 and 12) are superior in storability.

EXAMPLE 7

Sample Nos. 16 to 20 were prepared in the same manner as for Sample No. 2 of Example 1 except for adding water-soluble dye D-2 to have a coating amount as shown in Table 6 to the coating solution for the lower emulsion protective layer of Sample No. 2 of Example 1. These samples were exposed and developed in the same manner as the evaluation of letter image quality in Example 1. Replenishment rate of the developer was 160 ml per $m^2$ of the sample and replenishment rate of the fixing solution was 260 ml per $m^2$ of the sample.

Evaluation of the Fluctuation Amount of Dot Area

Fluctuation amounts of dot area (fluctuation from 50%) were evaluated when exposed at an exposure amount of 2 times or 3 times the exposure amount that is used in the evaluation of "practical Dmax".

The smaller the value, the more precise is the image, and halftone is hard to break.

TABLE 6

Dye D-2

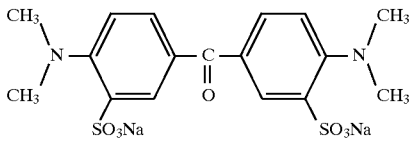

| | Amount of Dye | | Fluctuation Amount | |
|---|---|---|---|---|
| | Coating | Optical | Dot Area (dot %) | |
| Sample No. | Amount ($mg/m^2$) | Density at 360 nm | 2 Time Exposure | 3 Time Exposure |
| 15 | 0 | 0 | 4 | 7 |
| 16 | 25 | 0.10 | 3 | 6 |
| 17 | 50 | 0.20 | 3 | 5 |
| 18 | 75 | 0.30 | 2 | 4 |
| 19 | 100 | 0.40 | 2 | 3 |
| 20 | 150 | 0.59 | 2 | 2 |

As is apparent from the results in Table 6, Sample Nos. 16 to 20 are superior in fluctuation amount of dot area.

Further, when an optical density at 360 nm is 0.2 or more, the fluctuation amount of dot area becomes smaller (Sample Nos. 17 to 20).

EXAMPLE 8

Preparation of Emulsion

Emulsion D

An aqueous solution of silver nitrate and an aqueous solution of sodium chloride containing $(NH_4)_2Rh(H_2O)Cl_5$ were simultaneously added to a 1.5% aqueous solution of gelatin (pH: 2.0) being maintained at 40° C. and containing sodium chloride, $3\times10^{-3}$ mol/mol-Ag of sodium benzenethiosulfonate and $5\times10^{-3}$ mol/mol-Ag of 4-hydroxy-6-methyl-1,3,3a,7-tetrazaindene, by a double jet method at a potential of 95 mV, over 3 minutes and 30 seconds so that half of the silver amount of final grains were added, to thereby prepare core grains having a grain size of 0.12 μm.

Then, an aqueous solution of silver nitrate and an aqueous solution of sodium chloride containing $(NH_4)_2Rh(H_2O)Cl_5$ were added over 7 minutes in the same manner as above and silver chloride cubic grains having an average grain size of 0.16 μm were prepared (variation coefficient: 12%).

The mixture was then washed according to an ordinary flocculation method known in the art, soluble salt was removed, and gelatin was added. Then, the pH was adjusted to 5.7, pAg to 7.5, and further $1\times10^{-5}$ mol/mol-Ag of chloroauric acid, $5\times10^{-6}$ mol/mol-Ag of sodium thiosulfate and $5\times10^{-6}$ mol/mol-Ag of selenium sensitizer SE-3 were added and heated at 60° C. for 6 hours, and chemical sensitization was conducted. Then, Compound-F and phenoxyethanol as antiseptics each in an amount of 60 mg/mol-Ag, $1\times10^{-3}$ mol/mol-Ag of 4-hydroxy-6-methyl-1,3,3a,7-tetrazaindene as a stabilizer were added. Thus finally obtained grains had a pH of 5.7, a pAg of 7.5, Ru of $7\times10^{-6}$ mol/mol-Ag. (core/shell doping ratio: 1/3)

Emulsion E:

Emulsion E was prepared in the same manner as for Emulsion D, except that $K_2Ru(NO)Cl_5$ was doped instead of $(NH_4)_2Rh(H_2O)Cl_5$ in the grain formation, the doping amount was changed to $3.5\times10^{-6}$ mol/Ag mol, and that doping was conducted uniformly.

Emulsion F:

Emulsion F was prepared in the same manner as for Emulsion D, except that $K_2Ru(H_2O)Cl_5$ was doped instead of $(NH_4)_2Rh(H_2O)Cl_5$ in the grain formation, the doping amount was changed to $5\times10^{-6}$ mol/Ag mol, and that doping was conducted uniformly.

Emulsion G:

Emulsion G was prepared in the same manner as for Emulsion D, except that $(NH_4)_2Ru(H_2O)Cl_5$ was doped in an amount of $5\times10^{-6}$ mol/Ag mol (core/shell doping ratio: 1/3).

Preparation of Coating Solution for Emulsion Layer and Coating Thereof:

The following compounds were added to each of Emulsions D to G to prepare coating solutions, and the coating solutions were, respectively, coated on the same support having an undercoat layer as used in Example 1 to provide a silver halide emulsion layer having a gelatin coating amount of 0.9 g/m$^2$ and a silver coating amount of 2.7 g/m$^2$.

| | |
|---|---|
| 1-Phenyl-5-mercaptotetrazole | 10 mg/m$^2$ |
| Sodium 3-(5-Mercaptotetrazole-benzenesulfonate | 11 mg/m$^2$ |
| Sodium N-Oleyl-N-methyltaurine | 19 mg/m$^2$ |
| Nucleation Accelerator $B_1$ | 20 mg/m$^2$ |
| Compound A | 13 mg/m$^2$ |
| Compound B | 15 mg/m$^2$ |
| Compound C | 70 mg/m$^2$ |
| Ascorbic Acid | 1 mg/m$^2$ |
| Acetic Acid | an amount to provide film pH of 5.2 to 6.0 |
| Compound D | 1 g/m$^2$ |
| Liboran-1400 (manufactured by Lion Yushi) | 50 mg/m$^2$ |
| Compound E (hardening agent) | an amount to provide swelling factor in water of 80% |
| pH (adjusted to 5.6) | |

Further hydrazine nucleating agent was added each of the above obtained coating solutions as shown in Table 7.

Lower and upper emulsion protective layers were coated as upper layers on the above emulsion layer.

Preparation of Coating Solution for Lower Emulsion Protective Layer and Coating Thereof The following compounds were added to an aqueous solution of gelatin, and the thus obtained coating solution was coated to provide a lower emulsion protective layer having a gelatin coating amount of 0.8 g/m$^2$.

| | |
|---|---|
| Gelatin ($Ca^{++}$ content: 2,700 ppm) | 0.8 g/m$^2$ |
| Compound F | 1 mg/m$^2$ |
| 1,5-Dihydroxy-2-benzaldoxime | 14 mg/m$^2$ |
| $C_2H_5SO_2SNa$ | 3 mg/m$^2$ |
| Compound K | 20 mg/m$^2$ |
| Compound C | 3 mg/m$^2$ |
| Compound L | 200 mg/m$^2$ |
| Sodium p-Dodecylbenzenesulfonate | 7 mg/m$^2$ |
| Compound G | 20 mg/m$^2$ |
| Compound K | |

-continued

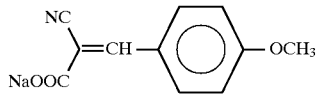

Compound L

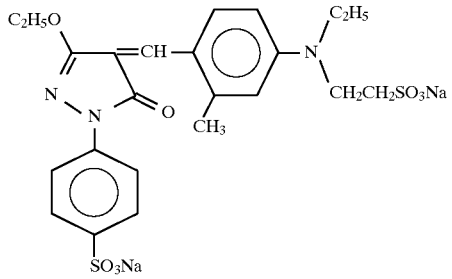

Preparation of Coating Solution for Upper Emulsion Protective Layer and Coating Thereof The following compounds were added to an aqueous solution of gelatin, and the thus obtained coating solution was coated to provide an upper emulsion protective layer having a gelatin coating amount of 0.45 g/m$^2$.

| | |
|---|---|
| Gelatin ($Ca^{++}$ content: 2,700 ppm) | 0.45 g/m$^2$ |
| Amorphous Silica Matting Agent (average particle size: 4.4 $\mu$m) | 40 mg/m$^2$ |
| Amorphous Silica Matting Agent (average particle size: 3.6 $\mu$m) | 10 mg/m$^2$ |
| Compound F | 1 mg/m$^2$ |
| Compound C | 8 mg/m$^2$ |
| Solid Dispersion Dye $G_1$ | 68 mg/m$^2$ |
| Flowing Paraffin | 21 mg/m$^2$ |
| Potassium N-Perfluorooctanesulfonyl-N-propylglycine | 5 mg/m$^2$ |
| Sodium p-Dodecylbenzenesulfonate | 29 mg/m$^2$ |

The same electrically conductive layer and the same backing layer as in Example 1 were coated on the opposite side of the support simultaneously.

Evaluating Method

Letter Image Quality

For evaluation of letter image quality, an original having the constitution of: a transparent film base; a film on which a positive image of line work is formed (line original); a transparent film base; and a film on which a halftone image is formed (halftone original) laminated in this order, as disclosed in FIG. 1 of JP-B-2-28856 was prepared. This original was contacted with the emulsion surface of each sample, imagewise exposed using P-627FM printer manufactured by Dai Nippon Screen Mfg. Co., Ltd., then subjected to development processing at 38° C. for 20 seconds with automatic processor FG-680AG (manufactured by Fuji Photo Film Co., Ltd.) with developing solution 1, followed by fixing, washing and drying. A fixing solution used was fixing solution 1. The exposure was conducted through a filter (Dialight P-1001 manufactured by Mitsubishi Rayon Co., Ltd., which has a thickness of 3 mm and a permeability of at 393 nm of 50%: This filter absorbs shorter wavelengths than 393 nm and permeates longer wavelengths than 393 nm.) disposed between a light source and the sample.

Practical Dmax

Two sets of samples were prepared by exposing a film sample to give an image having a dot area of 50% on the film with using a 50% halftone original, as described in the evaluation of letter image quality in Example 1. One set of samples was processed by Developing Solution 1 (fresh solution) and the other set was processed with an exhausted one of Developing Solution 1. The exhausted solution was prepared by using Developer Solution 1 in processing of 50 $m^2$/day for 5 days with replenishing rate of 50 ml per 20×24 inch paper (0.31 $m^2$). (Processing condition: 38° C., 20 sec., blacking ratio of 20%, replenishing rate of a fixing solution being 50 ml per 20×24 inch paper)

The results obtained are shown in Table 7 below.

TABLE 7

| Emulsion | | | | Hydrazine Nucleating Agent | | Letter | Practical Dmax | |
|---|---|---|---|---|---|---|---|---|
| Sample Name | No. | Kind of Heavy Metal (addition amount) (mol/mol Ag) | Chemical Sensitization | Kind | Addition Amount (mol/Ag mol) | Image Quality | Fresh Solution | Exhausted Solution |
| 21 | D | Rh ($7 \times 10^{-6}$) | Au/S/Se | I-23 | $0.3 \times 10^{-3}$ | 4 | 4.5 | 3.6 |
| 22 | D | " | " | I-2 | $0.8 \times 10^{-3}$ | 5 | 5.3 | 5.1 |
| | | | | I-23 | $0.3 \times 10^{-3}$ | | | |
| 23 | D | " | " | I-2 | $0.8 \times 10^{-3}$ | 5 | 5.2 | 5 |
| | | | | I-52 | $0.7 \times 10^{-3}$ | | | |
| 24 | D | " | " | I-1 | $1.3 \times 10^{-3}$ | 5 | 5.2 | 5.1 |
| | | | | I-23 | $0.3 \times 10^{-3}$ | | | |
| 25 | E | Ru ($3.5 \times 10^{-6}$) | Au/S/Se | I-2 | $0.8 \times 10^{-3}$ | 5 | 5.3 | 5.2 |
| | | | | I-23 | $0.3 \times 10^{-3}$ | | | |
| 26 | F | Ru ($5.0 \times 10^{-6}$) | Au/S/Se | I-2 | $0.8 \times 10^{-3}$ | 5 | 5.1 | 4.9 |
| | | | | I-52 | $0.7 \times 10^{-3}$ | | | |
| 27 | G | Rh ($5 \times 10^{-5}$) | Au/S/Se | I-2 | $0.8 \times 10^{-3}$ | 3.5 | 5 | 4.5 |
| | | | | I-23 | $1.2 \times 10^{-3}$ | | | |

From the results in Table 7, it is understood that higher Dmax can be obtained by a combined use of the hydrazine compounds for use in the present invention. Particularly, such an effect become remarkable when exposed with an exhausted developer.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein:

said silver halide emulsion layer comprises a silver halide comprising silver chloride or silver chlorobromide having a silver chloride content of not less than 95 mol %;

said silver halide emulsion comprises at least one transition metal selected from the group consisting of elements belonging to the groups V to VIII of the periodic table, said transition metal having only one nitrosyl, thionitrosyl or aquo ligand per molecule; and said silver halide is chemically sensitized with a selenium compound selected from compounds represented by one of the following formulae SE-1 to SE-8:

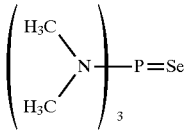

SE-1

-continued

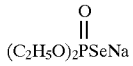

SE-2

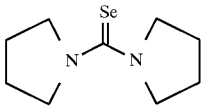

SE-3

-continued

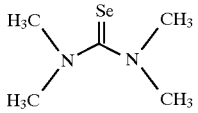

SE-4

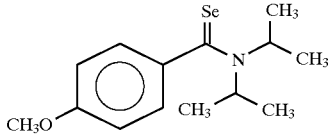

SE-5

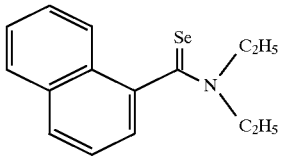

SE-6

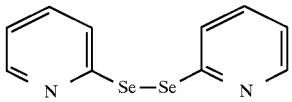

SE-7

$(^{n}\text{-}C_4H_9O)_3P{=}Se$

SE-8

2. The silver halide photographic material of claim 1, further comprising a hydrophilic colloid layer, wherein either or both of said silver halide emulsion layer and said hydrophilic colloid layer contains a hydrazine compound and a nucleation accelerator.

3. The silver halide photographic material of claim 1, wherein said chemical sensitization with a selenium compound is conducted at a ripening pH of from 4.7 to 6.0 and a ripening pAg of from 7.0 to 8.5.

4. The silver halide photographic material of claim 1, wherein said silver halide is pure silver chloride.

5. The silver halide photographic material of claim 1, wherein the silver halide is further sensitized by a gold sensitization and a sulfur sensitization.

6. The silver halide photographic material of claim 1, further comprising a hydrophilic colloid layer provided on the same side of the support on which said emulsion layer is provided, wherein said emulsion layer or hydrophilic colloid layer contains a water-soluble dye in an amount such that the optical density of the material at 360 nm becomes greater than 0.2.

7. The silver halide photographic material of claim 1, further comprising a hydrophilic colloid layer provided on the same side of the support on which said emulsion layer is provided, wherein said emulsion layer or hydrophilic colloid layer contains a water-soluble dye in an amount such that the optical density of the material at 360 nm becomes greater than 0.4.

8. The silver halide photographic material of claim 1, wherein the silver halide is prepared by a process comprising forming a silver halide grain and chemically sensitizing the grain wherein at least one compound represented by the following formula (1), (2) or (3) is added at either or both of said grain forming step and said chemically sensitizing step:

$$R—SO_2S—M \quad (1)$$

$$R—SO_2S—R' \quad (2)$$

$$R—SO_2S—L_m—SSO_2—R'' \quad (3)$$

wherein R, R' and R", which may be the same or different, each represents an aliphatic group, an aromatic group or a heterocyclic group; M represents a cation; L represents a divalent linking group; and m represents 0 or 1; and said compound represented by formula (1), (2) or (3) may be a polymer comprising a divalent group derived from the compound represented by (1), (2) or (3) as a repeating unit.

9. The silver halide photographic material of claim 1, wherein the total amount of gelatin on the side on which the emulsion layer is provided is not more than 3.0 $g/m^2$.

10. The silver halide photographic material of claim 1, further comprising a hydrophilic colloid layer, wherein at least one of said emulsion layer and said hydrophilic colloid layer contains a polymer latex.

* * * * *